US011254487B2

(12) United States Patent
Kase

(10) Patent No.: US 11,254,487 B2
(45) Date of Patent: Feb. 22, 2022

(54) MOLDING HEAD

(71) Applicant: YOSHINO KOGYOSHO CO., LTD., Tokyo (JP)

(72) Inventor: Mai Kase, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 251 days.

(21) Appl. No.: 16/486,406

(22) PCT Filed: Feb. 21, 2018

(86) PCT No.: PCT/JP2018/006206
§ 371 (c)(1),
(2) Date: Aug. 15, 2019

(87) PCT Pub. No.: WO2018/159410
PCT Pub. Date: Sep. 7, 2018

(65) Prior Publication Data

US 2020/0024064 A1 Jan. 23, 2020

(30) Foreign Application Priority Data

Feb. 28, 2017 (JP) ..... JP2017-037727

(51) Int. Cl.
*B65D 83/14* (2006.01)
*B65D 83/30* (2006.01)
(Continued)

(52) U.S. Cl.
CPC ..... *B65D 83/14* (2013.01); *B05B 1/14* (2013.01); *B65D 47/32* (2013.01); *B65D 83/20* (2013.01);
(Continued)

(58) Field of Classification Search
CPC ..... B65D 83/14; B65D 83/30; B65D 83/36; B65D 83/38; B65D 83/48; B65D 83/75;
(Continued)

(56) References Cited

U.S. PATENT DOCUMENTS 3,790,331 A * 2/1974 Backer ..... A23G 3/28 425/464
4,341,348 A * 7/1982 Dearling ..... A61L 9/12 239/326
(Continued)

FOREIGN PATENT DOCUMENTS

EP 0 255 575 A2 2/1988
JP H03-100186 U 10/1991
(Continued)

OTHER PUBLICATIONS

Apr. 10, 2018 Search Report issued in International Patent Application No. PCT/JP2018/006206.

*Primary Examiner* — Frederick C Nicolas
(74) *Attorney, Agent, or Firm* — Oliff PLC

(57) ABSTRACT

A molding head includes: an outer casing unit that has a top wall portion which is installed above a discharge hole and in which a plurality of shaping holes are formed, and that causes a molding surface of the top wall portion to discharge the content which has passed through the shaping holes; and an inner plate that is disposed inside the outer casing unit and defines a dispersion chamber between the inner plate and a supply surface of the top wall portion, in which a guide protrusion portion with which the content collides to be introduced to openings of the shaping holes on the molding surface side is formed on at least one of inner surfaces of the plurality of shaping holes, or in at least one of circumferential opening edge portions of the plurality of shaping holes on the supply surface side.

16 Claims, 17 Drawing Sheets

(51) Int. Cl.

| | |
|---|---|
| ***B65D 83/20*** | (2006.01) |
| ***B65D 47/32*** | (2006.01) |
| ***B05B 1/14*** | (2006.01) |
| *B65D 83/36* | (2006.01) |
| *B65D 83/38* | (2006.01) |
| *B65D 83/48* | (2006.01) |
| *B05B 11/00* | (2006.01) |
| *B65D 83/40* | (2006.01) |

(52) U.S. Cl.
CPC ..... *B65D 83/205* (2013.01); *B65D 83/30* (2013.01); *B65D 83/753* (2013.01); *B05B 11/3053* (2013.01); *B65D 83/36* (2013.01); *B65D 83/38* (2013.01); *B65D 83/40* (2013.01); *B65D 83/48* (2013.01); *B65D 83/75* (2013.01)

(58) Field of Classification Search
CPC ..... B65D 83/20; B65D 83/40; B65D 83/205; B65D 83/753; B65D 47/32; B05B 1/14; B05B 11/3053
See application file for complete search history.

(56) References Cited

U.S. PATENT DOCUMENTS

| | | | | |
|---|---|---|---|---|
| 5,813,785 | A * | 9/1998 | Baudin | B65D 83/285 401/190 |
| 10,421,089 | B2 * | 9/2019 | Kase | B05B 1/14 |
| 10,569,460 | B2 * | 2/2020 | Kase | B65D 83/753 |
| 10,829,293 | B2 * | 11/2020 | Kase | B65D 83/30 |
| 10,946,574 | B2 * | 3/2021 | Kase | B29C 48/21 |

FOREIGN PATENT DOCUMENTS

| | | | |
|---|---|---|---|
| JP | 2002-066388 | A | 3/2002 |
| JP | 2006-150279 | A | 6/2006 |
| JP | 2016-010919 | A | 1/2016 |
| JP | 2016-026962 | A | 2/2016 |

* cited by examiner

MOLDING HEAD

TECHNICAL FIELD

The present invention relates to a molding head.

Priority is claimed on Japanese Patent Application No. 2017-037727, filed Feb. 28, 2017, the content of which is incorporated herein by reference.

BACKGROUND ART

In the related art, for example, a molding head disclosed in the following Patent Document 1 is known. The molding head includes an outer casing unit that has a top wall portion which is installed above a discharge hole for discharging a content and in which a plurality of shaping holes penetrated in a vertical direction are formed, and causes an upwardly directed molding surface of the top wall portion to discharge a content which has passed through the shaping holes, and an inner plate that is disposed inside the outer casing unit and defines a dispersion chamber, which disperses a content from the discharge hole in a radial direction along the molding surface and supplies the content to the shaping holes, between the inner plate and a downwardly directed supply surface of the top wall portion. In this molding head, a molded article is formed on the molding surface by combining a plurality of molding pieces formed by a content from the dispersion chamber passing through each of the plurality of shaping holes.

DOCUMENT OF RELATED ART

Patent Document

Patent Document 1: Japanese Unexamined Patent Application, First Publication No. 2016-010919

SUMMARY OF INVENTION

Technical Problem

However, in molding heads in the related art, for example, in a shaping hole, of a plurality of shaping holes, positioned far away from a discharge hole, or a shaping hole having a long hole shape extending in a sharply curved manner, it is difficult to form molding pieces with high accuracy.

For example, if the shaping holes are simply enlarged in order to solve this, it becomes difficult for molding pieces to maintain, on a molding surface, the shape and the posture thereof as desired, so that it is also difficult to form molding pieces with high accuracy.

Therefore, it is considerably difficult to adjust forms of molding pieces while the accuracy is maintained, regardless of a distance from a discharge hole, a shape, a size, and the like of a shaping hole.

The present invention has been made in consideration of the foregoing problems, and an object thereof is to provide a molding head in which forms of molding pieces can be adjusted while the accuracy is maintained, regardless of the distance from a discharge hole, the shape, the size, and the like of a shaping hole.

Solution to Problem

A molding head according to the present invention includes: an outer casing unit that has a top wall portion which is installed above a discharge hole for discharging a content and in which a plurality of shaping holes penetrated in a vertical direction are formed, and that causes a molding surface of the top wall portion to discharge the content which has passed through the shaping holes, the molding surface being directed upward; and an inner plate that is disposed inside the outer casing unit and defines, between the inner plate and a supply surface of the top wall portion, a dispersion chamber which disperses the content from the discharge hole in a radial direction along the molding surface and supplies the content to the shaping holes, the supply surface being directed downward, in which the molding head forms a molded article on the molding surface by combining a plurality of molding pieces formed by the content from the dispersion chamber passing through the plurality of shaping holes, and a guide protrusion portion with which the content collides to be introduced to openings of the shaping holes on the molding surface side is formed on at least one of inner surfaces of the plurality of shaping holes, or in at least one of circumferential opening edge portions of the plurality of shaping holes on the supply surface side.

In the present invention, the guide protrusion portion is formed in the outer casing unit. Therefore, a content which has flowed into the dispersion chamber through the discharge hole can be introduced to the openings of the shaping holes on the molding surface side by causing the content to collide with the guide protrusion portion, so that the accuracy of forms, such as the shape, the posture, and the size, of molding pieces discharged from these shaping holes to the molding surface can be improved. Therefore, for example, even with a shaping hole or the like having a long hole shape extending in a sharply curved manner, molding pieces can be formed with high accuracy. Accordingly, forms of molding pieces can be easily adjusted while the accuracy is maintained, regardless of the distance from the discharge hole, the shape, the size, and the like of the shaping holes, so that various types of molded article can be easily formed with high accuracy.

Here, at least one of the plurality of shaping holes may have a guide surface, at least an end portion of the guide surface on the molding surface side extending gradually away from an opposite inner surface facing the guide surface while going from the supply surface side to the molding surface side in a longitudinal sectional view in the vertical direction.

In this case, the shaping hole has the guide surface of which at least the end portion on the molding surface side extends gradually away from the opposite facing inner surface while going from the supply surface side to the molding surface side in the longitudinal sectional view. Therefore, when a content is discharged through the shaping holes to the molding surface, the content is introduced in a direction away from the opposite inner surface, such that molding pieces can extend upward in a state of being inclined with respect to the molding surface in a direction away from the opposite inner surface, without causing the molding pieces to extend in a straight line upward from the molding surface. Accordingly, it is possible to accurately form molding pieces extending upward in a state of being inclined with respect to the molding surface.

In addition, at least the end portion of the guide surface on the molding surface side may have a protruding curved line shape in the longitudinal sectional view.

In this case, at least the end portion of the guide surface on the molding surface side has a protruding curved line shape in the longitudinal sectional view. Therefore, for example, even if the shaping holes have a complicated shape such as a long hole shape extending in a sharply curved manner, it is possible to accurately form molding pieces extending upward in a state of being inclined with respect to the molding surface.

In addition, the guide protrusion portion may include an outer protrusion portion which protrudes downward from a part, of the circumferential opening edge portion of the shaping hole on the supply surface side, connected to the guide surface of the shaping hole in the longitudinal sectional view.

In this case, a content which has flowed in the dispersion chamber in the radial direction and has arrived at the circumferential opening edge portions of the shaping holes on the supply surface side can be upwardly introduced into the shaping holes by causing the content to collide with the outer protrusion portion, so that the content can be smoothly introduced to the openings of the shaping holes on the molding surface side.

In addition, the guide protrusion portion may include a first inner protrusion portion which protrudes from the opposite inner surface toward the guide surface in the shaping hole in the longitudinal sectional view.

In this case, a content which has flowed into the shaping holes from the dispersion chamber can be separated from the opposite inner surface and can be directed toward the guide surface by causing the content to collide with the first inner protrusion portion. At this time, at least the end portion of the guide surface on the molding surface side extends gradually away from the opposite inner surface while going from the supply surface side to the molding surface side. Therefore, the content which has been introduced from the first inner protrusion portion to the guide surface side can be smoothly introduced to the openings of the shaping holes on the molding surface side.

In addition, a second inner protrusion portion which protrudes toward the opposite inner surface may be formed on a part, of the guide surface of the shaping hole, positioned below the first inner protrusion portion formed on the opposite inner surface in the longitudinal sectional view.

In this case, in the longitudinal sectional view, the second inner protrusion portion which protrudes toward the opposite inner surface is formed on a part, of the guide surface, positioned below the first inner protrusion portion. Therefore, even if a part of a content which has collided with the first inner protrusion portion tends to flow back downward, the second inner protrusion portion can block the flow-back and introduce the part of the content to the guide surface, so that the content which has been introduced from the first inner protrusion portion to the guide surface side can be more smoothly introduced toward the openings of the shaping holes on the molding surface side.

In addition, in at least one of the plurality of shaping holes, an opening area on the molding surface side may be smaller than an opening area on the supply surface side.

In this case, the opening area of the shaping hole on the molding surface side is smaller than the opening area thereof on the supply surface side. Therefore, a content in the dispersion chamber can easily flow into the shaping holes while distortion of molding pieces is prevented, so that molding pieces can be reliably formed with high accuracy even with a shaping hole into which the content from the dispersion chamber does not easily flow.

In addition, at least one of the plurality of shaping holes may be a long hole, and the guide protrusion portion may be formed on a side surface, of the inner surface defining the long hole, extending in a direction in which the long hole extends, or in a part, of the circumferential opening edge portion of the long hole on the supply surface side, connected to the side surface.

In this case, the guide protrusion portion is formed on the side surface of the long hole or in a part, of the circumferential opening edge portion of the long hole on the supply surface side, connected to the side surface. Therefore, even with a long hole into which a content from the dispersion chamber does not easily flow, molding pieces can be formed with high accuracy by causing the content to pass through this long hole.

Advantageous Effects of Invention

According to this invention, forms of molding pieces can be adjusted while the accuracy is maintained, regardless of the distance from the discharge hole, the shape, the size, and the like of the shaping holes.

DESCRIPTION OF EMBODIMENTS

Hereinafter, a first embodiment according to the present invention will be described with reference to the drawings.

Figure 1:
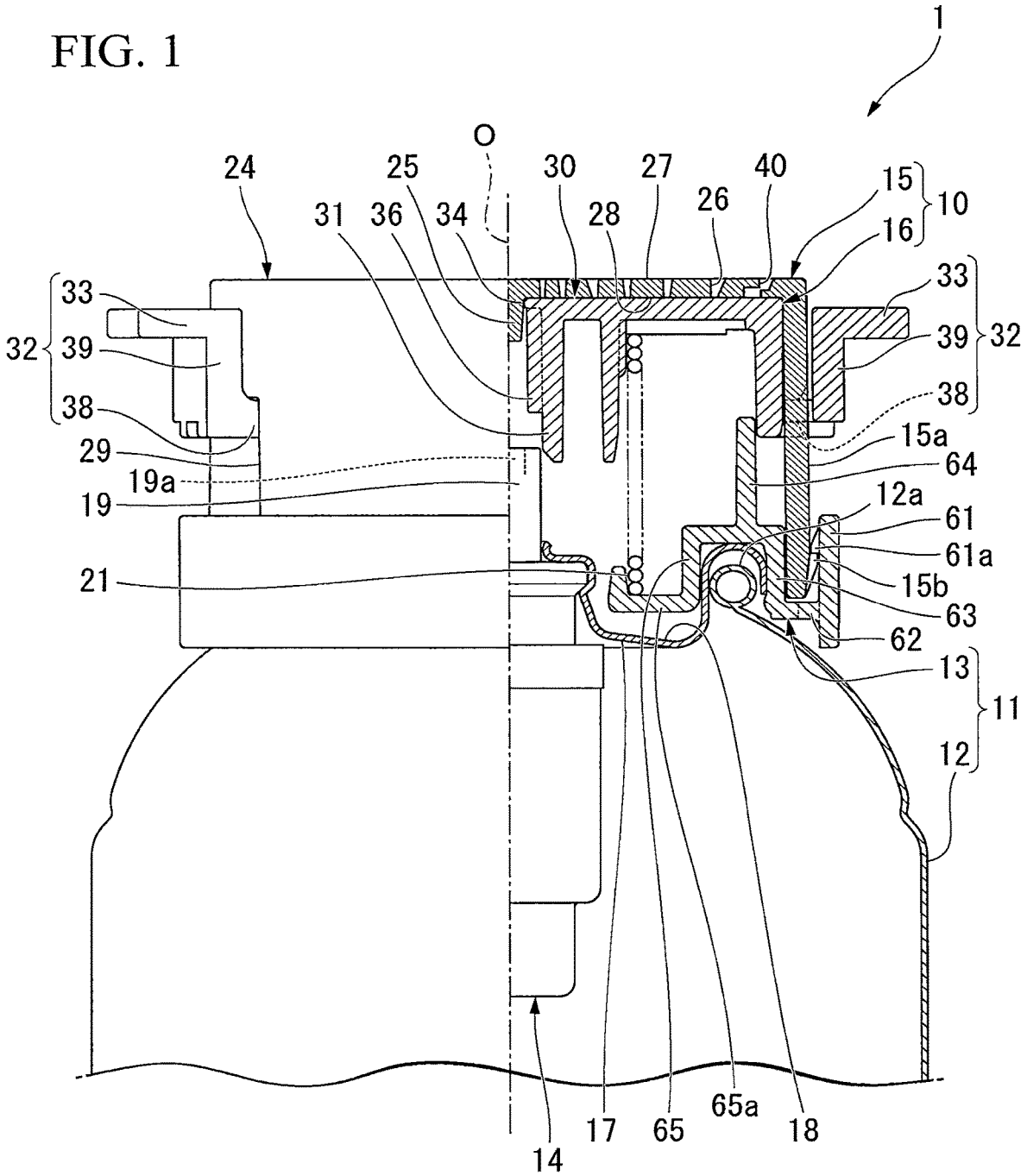
FIG. 1 is a partial longitudinal sectional view of a discharge container according to a first embodiment of the present invention, and the diagram illustrates a state in which an inner plate is positioned at a standby position.

As illustrated in FIG. 1, a discharge container 1 includes a container body 11 including a container main body 12 in which a content is contained, a discharger 14, and a molding head 10. The discharge container 1 discharges a content, for example a foam or a high-viscosity material, which can retain its shape at least for a certain period of time after being discharged.

Here, the container main body 12 is formed to have a bottomed cylinder shape. Hereinafter, a straight line passing through the center of the container main body 12 in a cross section thereof will be referred to as a container axis O, a bottom portion side of the container main body 12 in a direction along the container axis O will be referred to as a lower side, a mouth portion 12*a* side of the container main body 12 in the direction along the container axis O will be referred to as an upper side, and the direction along the container axis O will be referred to as a vertical direction. In a top view of the discharge container 1, a direction orthogonal to the container axis O will be referred to as a radial direction, and a direction of turning around the container axis O will be referred to as a circumferential direction.

The container body 11 includes the container main body 12 and a fixing member 13 which is mounted to the mouth portion 12*a* of the container main body 12. The inside of the container main body 12 is sealed by a top plate 17 covering the mouth portion 12*a*. An annular recess portion 18 extending in the circumferential direction is provided in the top plate 17.

The discharger 14 includes a stem 19 which is erected inside the mouth portion 12*a* of the container main body 12 so as to be movable downward in an upwardly biased state. The stem 19 is disposed coaxially with the container axis O and is formed to have a smaller diameter than the annular recess portion 18. The stem 19 penetrates the top plate 17 in the vertical direction. A discharge valve (not illustrated) and a biasing member (not illustrated) for upwardly biasing the stem 19 are provided inside the discharger 14 positioned in the container main body 12.

When the stein 19 is pushed down with respect to the container main body 12, the discharge valve is opened, and a content inside the container main body 12 is discharged from an upper end opening portion (discharge hole) 19*a* of the stem 19 through the inside of the stem 19. At this time, for example, a content in a foam state is discharged from the upper end opening portion 19*a* of the stem 19. A content discharged from the upper end opening portion 19*a* of the stem 19 does not have to be in a foam state. When the push-down of the stem 19 is released, the stem 19 rises due to an upward biasing force of the biasing member acting on the stem 19, and the discharge valve is closed, so that a content stops being discharged.

The container main body 12 and the discharger 14 constitute a discharge container main body which discharges a content contained inside the container main body 12 from the stem 19. In the illustrated example, an aerosol can which internally contains a liquid content is employed as the discharge container main body.

The fixing member 13 is fixed to the mouth portion 12*a* of the container main body 12 such that the stein 19 is enclosed from the outside in the radial direction. The fixing member 13 is fixed to the mouth portion 12*a* of the container main body 12 so as to be incapable of rotating around the container axis O and incapable of rising.

The fixing member 13 includes an external fitting cylinder 63 which is externally fitted to the mouth portion 12*a* of the container main body 12 with the top plate 17 interposed therebetween, an enclosing cylinder 61 which encloses the external fitting cylinder 63 from the outside in the radial direction, a plurality of connection portions 62 which connect the external fitting cylinder 63 and the enclosing cylinder 61 to each other and are disposed with gaps therebetween in the circumferential direction, an inner cylinder portion 65 which is fitted into the annular recess portion 18 of the top plate 17, and a protruding cylinder portion 64 which has a bottomed cylinder shape with a bottom portion straddling an upper end opening edge of the mouth portion 12*a* of the container main body 12 in the radial direction and connecting an upper end portion of the external fitting cylinder 63 and an upper end portion of the inner cylinder portion 65 to each other.

The enclosing cylinder 61, the external fitting cylinder 63, the inner cylinder portion 65, and the protruding cylinder portion 64 are disposed coaxially with the container axis O. A plurality of upper engagement portions 61*a* extending in the circumferential direction are formed on an inner circumferential surface of the enclosing cylinder 61 at intervals in the circumferential direction. The upper engagement portions 61*a* protrude inward in the radial direction from the inner circumferential surface of the enclosing cylinder 61. The upper engagement portions 61*a* are formed to have a projected shape extending in the circumferential direction.

The amount of the upper engagement portion 61*a* protruding inward in the radial direction from the inner circumferential surface of the enclosing cylinder 61 is smaller than a gap in the radial direction between the inner circumferential surface of the enclosing cylinder 61 and an outer circumferential surface of the external fitting cylinder 63.

Figure 6:
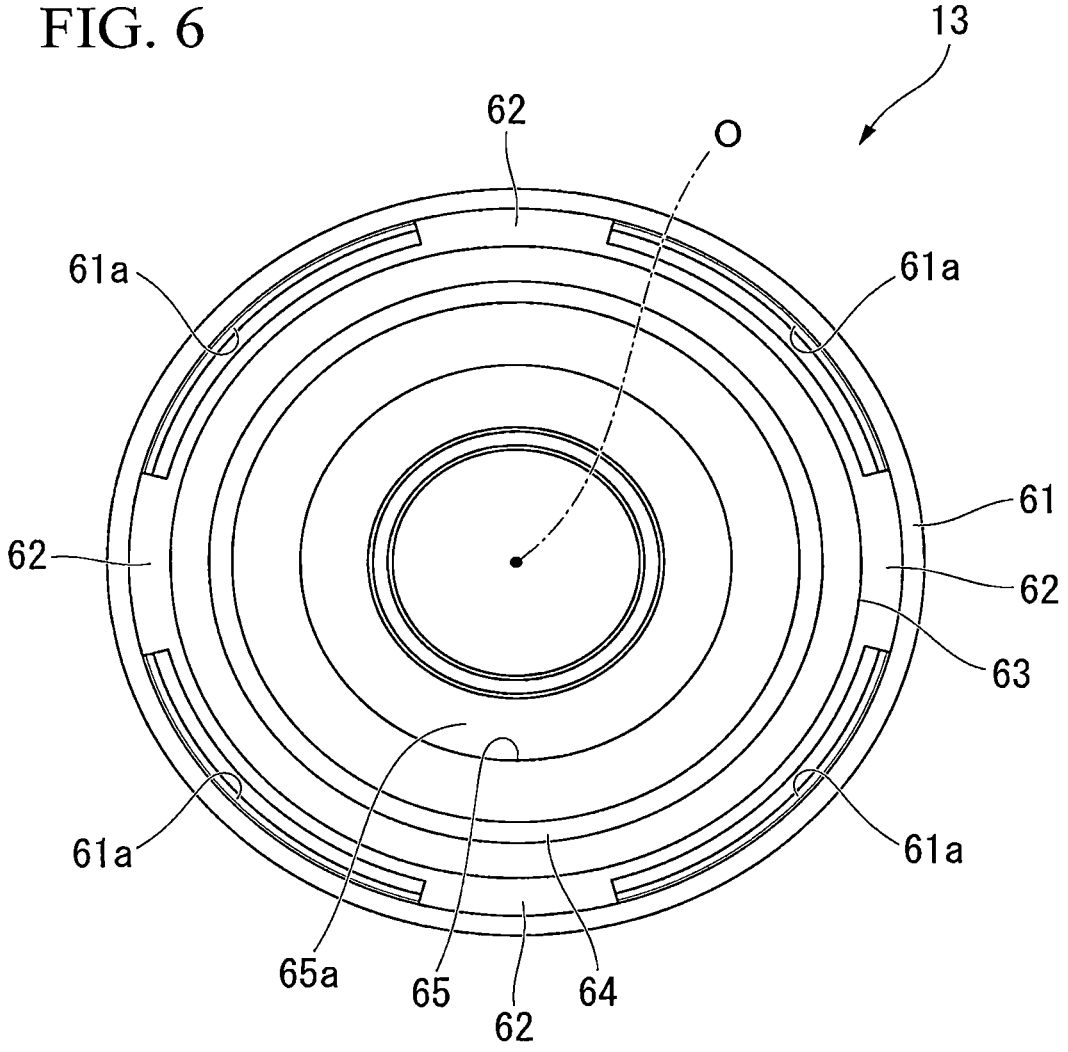
FIG. 6 is a top view of a fixing member of the discharge container illustrated in FIG. 1.

As illustrated in FIG. 6, the connection portions 62 connect the enclosing cylinder 61 and the external fitting cylinder 63 to each other in the radial direction. The shape of the connection portion 62 in a top view is a rectangular shape elongated in the circumferential direction. A plurality of connection portions 62 are disposed at equal intervals in the circumferential direction. The length of the connection portion 62 in the circumferential direction is shorter than the length of a gap in the circumferential direction between the connection portions 62 adjacent to each other in the circumferential direction. The gap between the connection portions 62 is penetrated in the vertical direction.

Figure 5:
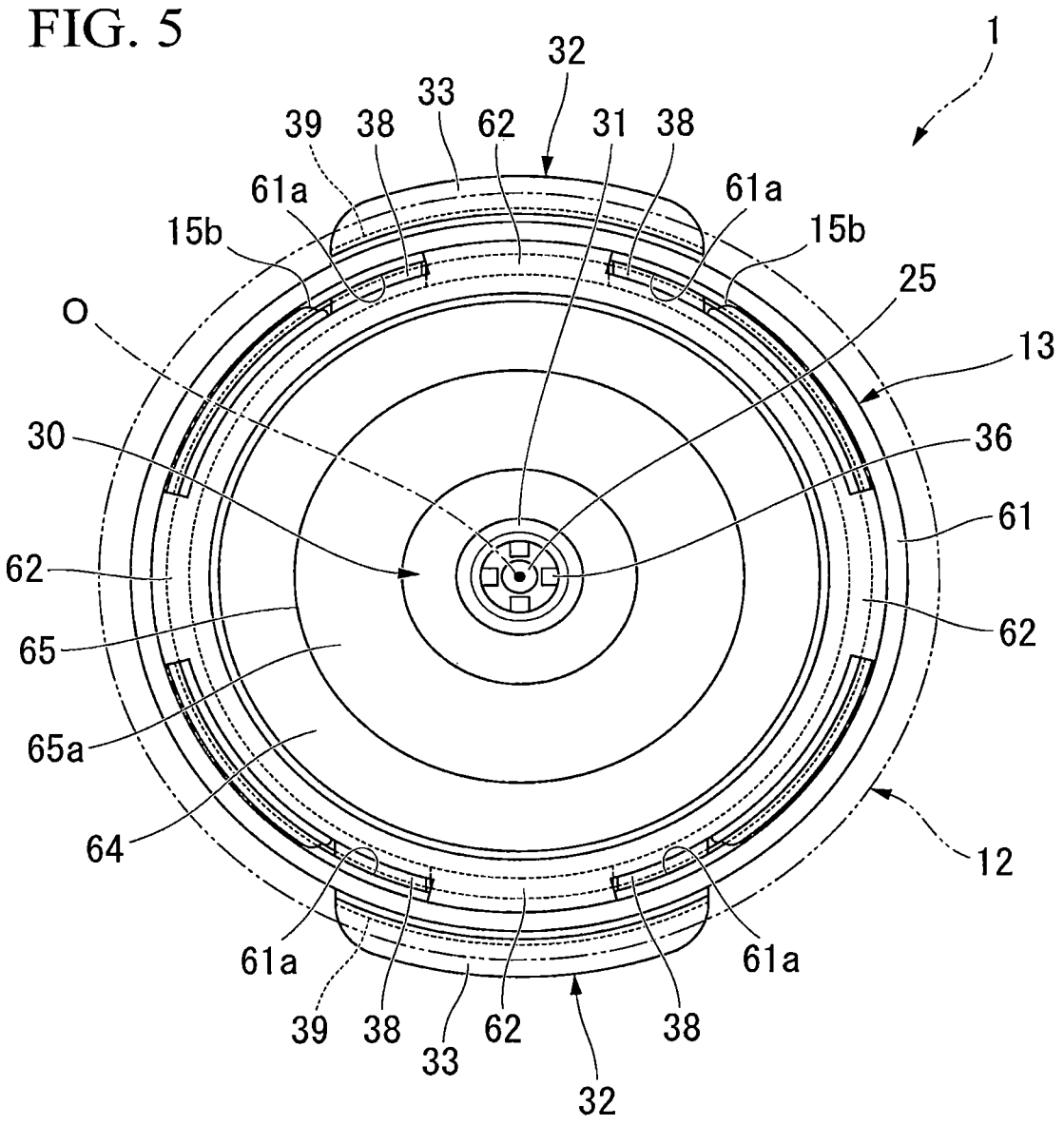
FIG. 5 is a bottom view of a part of the discharge container illustrated in FIG. 1 excluding the container main body.

The length of the upper engagement portion 61*a* in the circumferential direction is equal to or shorter than the length of the gap in the circumferential direction between the connection portions 62 adjacent to each other in the circumferential direction. As illustrated in FIGS. 5 and 6, in plan view viewed in the vertical direction, the upper engagement portions 61*a* are positioned on the inner side of the gaps between the connection portions 62 adjacent to each other in the circumferential direction.

As illustrated in FIG. 1, the inner cylinder portion 65 is fitted, from the inner side in the radial direction, to the outer circumferential surface of the annular recess portion 18 directed inward in the radial direction. A receiving plate portion 65*a* protruding inward in the radial direction and supporting a lower end portion of a biasing member 21 (which will be described below) is formed in the inner cylinder portion 65 throughout the whole circumference.

An outer circumferential surface of a circumferential wall of the protruding cylinder portion 64 is in contact with or close to an inner circumferential surface of an inner plate main body 30 (which will be described below).

The molding head 10 includes an outer casing unit 15 and an inner plate 16.

The outer casing unit 15 has a top wall portion 24 which is installed above the upper end opening portion 19*a* of the stem 19 and in which a plurality of shaping holes 26 penetrated in the vertical direction are formed, and discharges a content which has passed through the shaping holes 26 on a molding surface 27 of the top wall portion 24 which is directed upward. The outer casing unit 15 is formed to have a lidded cylinder shape including the top wall portion 24 and a circumferential wall portion 15*a* which extends downward from an outer circumferential edge of the top wall portion 24. The outer casing unit 15 is disposed coaxially with the container axis O.

A core body 25 protruding downward is formed in the top wall portion 24. The core body 25 is disposed coaxially with the container axis O. The core body 25 is positioned on the upper side of the stem 19. The outer diameter of the core body 25 is smaller than the inner diameter of the stem 19, and the core body 25 faces the upper end opening portion 19*a* of the stem 19 in the vertical direction. The core body 25 is formed to have a solid rod shape. The core body 25 gradually increases in diameter while going downward. The outer diameter of the upper end portion of the core body 25 is smaller than the inner diameter of the stem 19 and the inner diameter of a communication hole 34 of the inner plate 16 (which will be described below).

The plurality of shaping holes 26 open on the molding surface 27 which is directed upward and a supply surface 28 of the top wall portion 24 which is directed downward. The molding surface 27 and the supply surface 28 are orthogonal to the container axis O.

Figure 4:
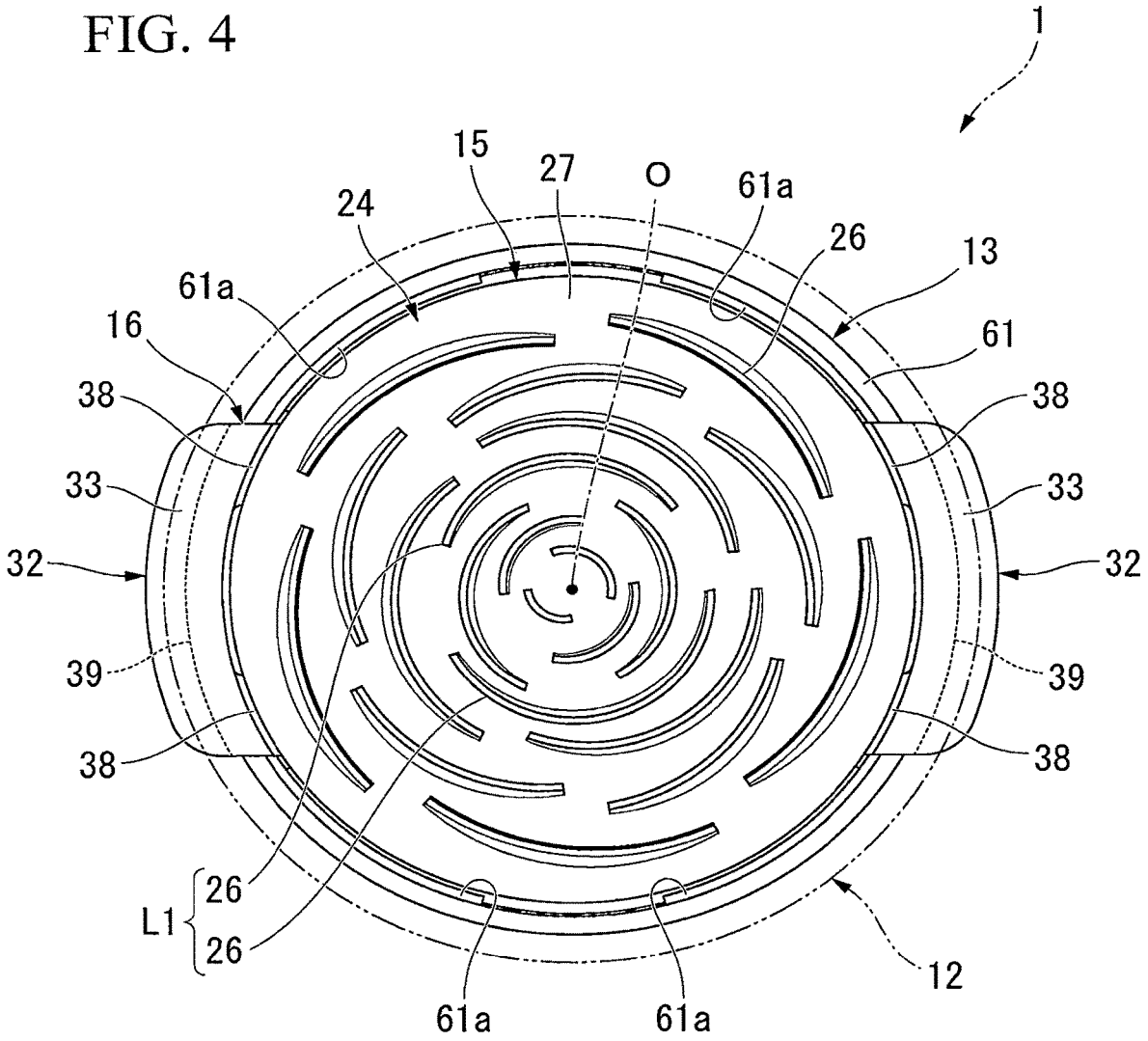
FIG. 4 is a top view of a part of the discharge container illustrated in FIG. 1 excluding a container main body.
Figure 7A:
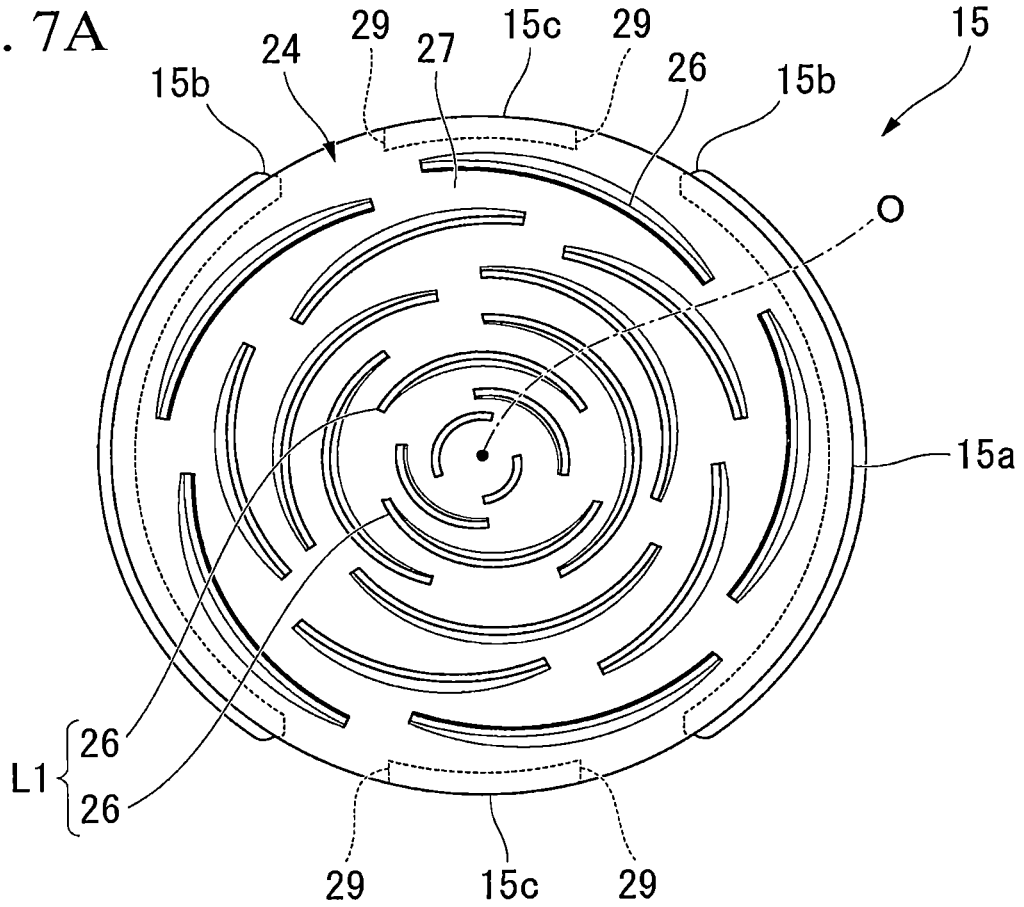
FIG. 7A is a top view of an outer casing unit of the discharge container illustrated in FIG. 1.
Figure 7B:
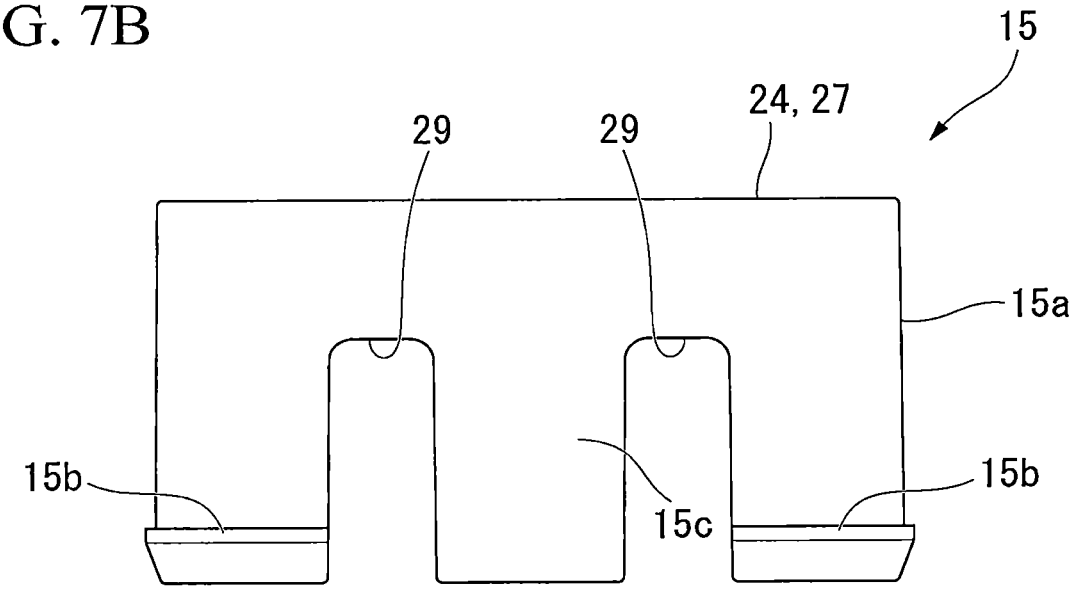
FIG. 7B is a side view of the outer casing unit of the discharge container illustrated in FIG. 1.

As illustrated in FIGS. 4, 7A, and 7B, the shaping holes 26 are long holes extending in the circumferential direction.

The plurality of shaping holes 26 are disposed at intervals in the circumferential direction and the radial direction. The plurality of shaping holes 26 disposed at intervals in the circumferential direction form a hole line L1, and multiple hole lines 1 are disposed about the container axis O. In a top view, the hole lines L1 are disposed to surround the core body 25 from the outside in the radial direction.

Regarding a molded article, for example, a shape such as a flower including a rose, a sunflower, or a cherry blossom, a letter, or a logotype can be molded. The shape of a molded article to be molded can be changed by suitably changing the number or the shape of shaping holes 26. The number or the shape of shaping holes 26 may be suitably changed in accordance with the purpose or the like of a content to be discharged.

Figure 2:
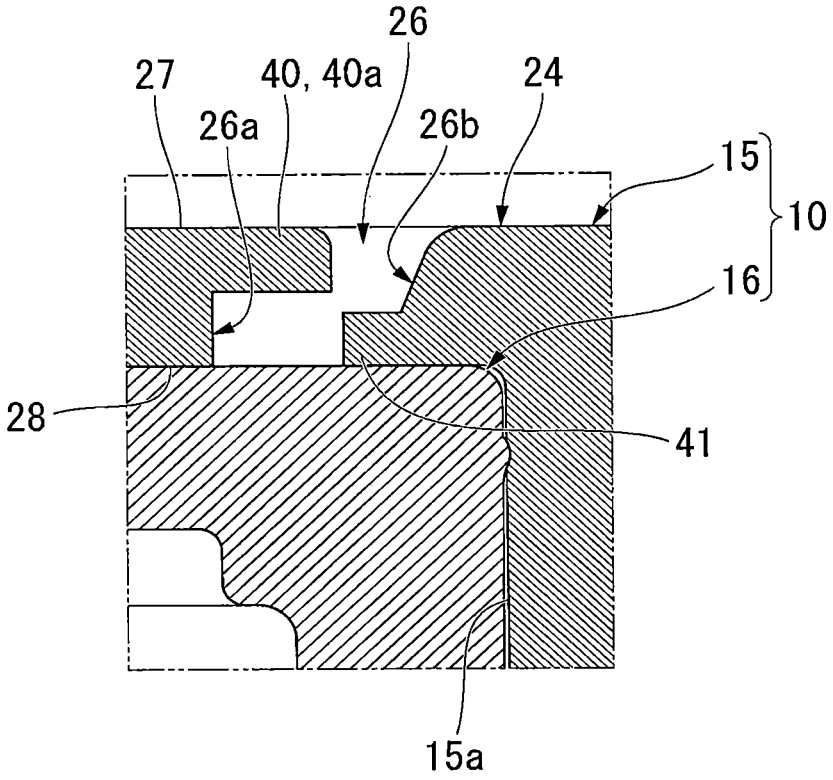
FIG. 2 is an enlarged view of a main part of the discharge container illustrated in FIG. 1.

Here, in the present embodiment, in a longitudinal sectional view in the vertical direction as illustrated in FIG. 2, at least one of the plurality of shaping holes 26 has a guide surface 26*b* of which at least an end portion on the molding surface 27 side extends gradually away from an inner surface (which will hereinafter be referred to as a facing surface) 26*a* which faces the guide surface 26*b*, while going from the supply surface 28 side toward the molding surface 27 side. At least the end portion of the guide surface 26*b* on the molding surface 27 side has a protruding curved line shape in the longitudinal sectional view.

In the illustrated example, throughout the whole region, the guide surface 26*b* extends gradually away from the facing surface 26*a* while going from the supply surface 28 side toward the molding surface 27 side. The end portion of the guide surface 26*b* on the molding surface 27 side has the protruding curved line shape in the longitudinal sectional view, and a part of the guide surface 26*b* positioned on the supply surface 28 side than this end portion has a linear shape in the longitudinal sectional view. Of a pair of side surfaces extending in the circumferential direction and defining the inner surface of the shaping hole 26, an inner side surface which is positioned on the inner side in the radial direction and is directed outward in the radial direction is the facing surface 26*a*, and an outer side surface which is positioned on the outer side in the radial direction and is directed inward in the radial direction is the guide surface 26*b*. In a top view, the guide surface 26*b* is positioned farther away from the upper end opening portion 19*a* of the stem 19 than the facing surface 26*a* is. The inclination angle of the guide surface 26*b* with respect to the vertical direction is larger than the inclination angle of the facing surface 26*a* with respect to the vertical direction. The facing surface 26*a* extends in a straight line in the vertical direction in the longitudinal sectional view. The guide surface 26*b* may be formed to have a protruding curved surface shape throughout the whole region.

The guide surface 26*b* is formed on the inner surfaces of the shaping holes 26, of the plurality of shaping holes 26, positioned on the outermost side in the radial direction. The guide surface 26*b* is formed on the inner surfaces of all of the plurality of shaping holes 26 constituting the hole line L1, of the plurality of hole lines L1, positioned on the outermost side in the radial direction. The guide surface 26*b* is not limited to the present embodiment. For example, the guide surface 26*b* may be suitably changed in accordance with a molded article to be formed on the molding surface 27, such that the guide surface 26*b* may be provided on the inner surfaces of the shaping holes 26, of the plurality of shaping holes 26, positioned on the innermost side in the radial direction.

In the present embodiment, a guide protrusion portion 40 with which a content collides to be introduced to openings of the shaping holes 26 on the molding surface 27 side is formed on at least one of the inner surfaces of the plurality of shaping holes 26 or in at least one of circumferential opening edge portions of the plurality of shaping holes 26 on the supply surface 28 side.

The guide protrusion portion 40 is formed on the inner surfaces of the shaping holes 26, of the plurality of shaping holes 26, positioned on the outermost side in the radial direction or in the circumferential opening edge portions of these shaping holes 26 on the supply surface 28 side.

In the illustrated example, the guide protrusion portions 40 are disposed in all of the plurality of shaping holes 26 constituting the hole line L1, of the plurality of hole lines L1, positioned on the outermost side in the radial direction. The shaping hole 26 in which the guide protrusion portion 40 is disposed is not limited to the present embodiment. For example, the guide protrusion portion 40 may be suitably changed in accordance with a molded article to be formed on the molding surface 27, such that the guide protrusion portions 40 may be disposed in the shaping holes 26, of the plurality of shaping holes 26, positioned on the innermost side in the radial direction.

The guide protrusion portion 40 is formed on the facing surface 26*a* of the shaping hole 26 or in a part, of the circumferential opening edge portion of the shaping hole 26 on the supply surface 28 side, connected to the guide surface 26*b* of the shaping hole 26. In the illustrated example, the guide protrusion portion 40 includes a first inner protrusion portion 40*a* which protrudes from the facing surface 26*a* of the shaping hole 26 toward the guide surface 26*b* in the longitudinal sectional view.

The first inner protrusion portion 40*a* is formed throughout the overall length in the circumferential direction on the facing surface 26*a* of the shaping hole 26. The first inner protrusion portion 40*a* is disposed throughout the whole region in an upper portion of the facing surface 26*a* of the shaping hole 26. The length of the first inner protrusion portion 40*a* in the vertical direction is shorter than half the length of the shaping hole 26 in the vertical direction. An upper end surface of the first inner protrusion portion 40*a* is flush with the molding surface 27. A lower end surface of the first inner protrusion portion 40*a* is a flat surface directed downward. A distal end surface of the first inner protrusion portion 40*a* directed toward the guide surface 26*b* extends in a straight line in the vertical direction. In the longitudinal sectional view, the length of the distal end surface of the first inner protrusion portion 40*a* is shorter than the length of the lower end surface of the first inner protrusion portion 40*a*.

In the longitudinal sectional view, a second inner protrusion portion 41 which protrudes toward the facing surface 26*a* is formed in a part, of the guide surface 26*b* of the shaping hole 26, positioned below the first inner protrusion portion 40*a* formed on the facing surface 26*a*.

The second inner protrusion portion 41 is formed throughout the overall length in the circumferential direction on the guide surface 26*b* of the shaping hole 26. The second inner protrusion portion 41 is disposed throughout the whole region in a lower portion of the guide surface 26*b* of the shaping hole 26. The length of the second inner protrusion portion 41 in the vertical direction is shorter than half the length of the shaping hole 26 in the vertical direction. A lower end surface of the second inner protrusion portion 41 is flush with the supply surface 28. An upper end surface of the second inner protrusion portion 41 is a flat surface directed upward. A distal end surface of the second inner protrusion portion 41 directed toward the facing surface 26*a* extends in a straight line in the vertical direction. In the longitudinal sectional view, the length of the distal end surface of the second inner protrusion portion 41 is equivalent to the length of the upper end surface of the second inner protrusion portion 41.

The upper end surface of the second inner protrusion portion 41 is positioned below the lower end surface of the first inner protrusion portion 40*a*.

A gap in the radial direction is provided between the distal end surface of the second inner protrusion portion 41 and the distal end surface of the first inner protrusion portion 40*a*.

In at least one of the plurality of shaping holes 26, the opening area on the molding surface 27 side is smaller than the opening area on the supply surface 28 side.

In the illustrated example, in the shaping holes 26, of the plurality of shaping holes 26, positioned on the outermost side in the radial direction, the opening area on the molding surface 27 side is smaller than the opening area on the supply surface 28 side. In all of the plurality of shaping holes 26 constituting the hole line L1, of the plurality of hole lines L1, positioned on the outermost side in the radial direction, the opening area on the molding surface 27 side is smaller than the opening area on the supply surface 28 side.

Without being limited to the present embodiment, for example, the opening area may be suitably changed in accordance with a molded article to be formed on the molding surface 27, such that the opening area on the molding surface 27 side may be smaller than the opening area on the supply surface 28 side in the shaping holes 26, of the plurality of shaping holes 26, positioned on the innermost side in the radial direction.

The circumferential wall portion 15*a* of the outer casing unit 15 is inserted into a space between the external fitting cylinder 63 and the enclosing cylinder 61 in the fixing member 13. Lower engagement portions 15*b* which protrude outward in the radial direction and engage with the upper engagement portions 61*a* of the enclosing cylinder 61 from below the upper engagement portions 61*a* are formed on the outer circumferential surface of the circumferential wall portion 15*a*. The length of the lower engagement portion 15*b* in the circumferential direction is larger than the length of the upper engagement portion 61*a* in the circumferential direction, and the number of lower engagement portions 15*b* is fewer than the number of upper engagement portions 61*a*. As illustrated in FIGS. 4 to 6, in plan view viewed in the vertical direction, two upper engagement portions 61*a* adjacent to each other in the circumferential direction engage with one lower engagement portion 15*b*. All of the plurality of upper engagement portions 61*a* engage with any of the lower engagement portions 15*b*.

Insertion holes 29 which are open downward while being penetrated in the radial direction are formed in the circumferential wall portion 15*a* of the outer casing unit 15. As illustrated in FIGS. 7A and 7B, the insertion holes 29 are formed to have a rectangular shape elongated in the vertical direction when viewed from the outside in the radial direction. Four insertion holes 29 are formed in the circumferential wall portion 15*a* at intervals in the circumferential direction. Two insertion holes 29 making a set are adjacent to each other in the circumferential direction, and the sets are formed in parts facing each other in the radial direction in the circumferential wall portion 15*a*.

Here, the lower engagement portions 15*b* formed in the circumferential wall portion 15*a* are divided in the circumferential direction by the insertion holes 29. Moreover, the lower engagement portions 15*b* are formed, on the outer circumferential surface of the circumferential wall portion 15*a*, at positions avoiding insertion wall portions 15*c* positioned between two insertion holes 29 adjacent to each other in the circumferential direction. End portions of the lower engagement portions 15*b* in the circumferential direction are positioned at the circumferential opening edge portions of the insertion holes 29 in the circumferential wall portion 15*a*.

The inner plate 16 is disposed inside the outer casing unit 15 and defines a dispersion chamber 35, which disperses a content from the upper end opening portion 19*a* of the stem 19 in the radial direction along the molding surface 27 and supplies the content to the shaping holes 26, between the inner plate 16 and the supply surface 28 of the top wall portion 24.

Figure 3:
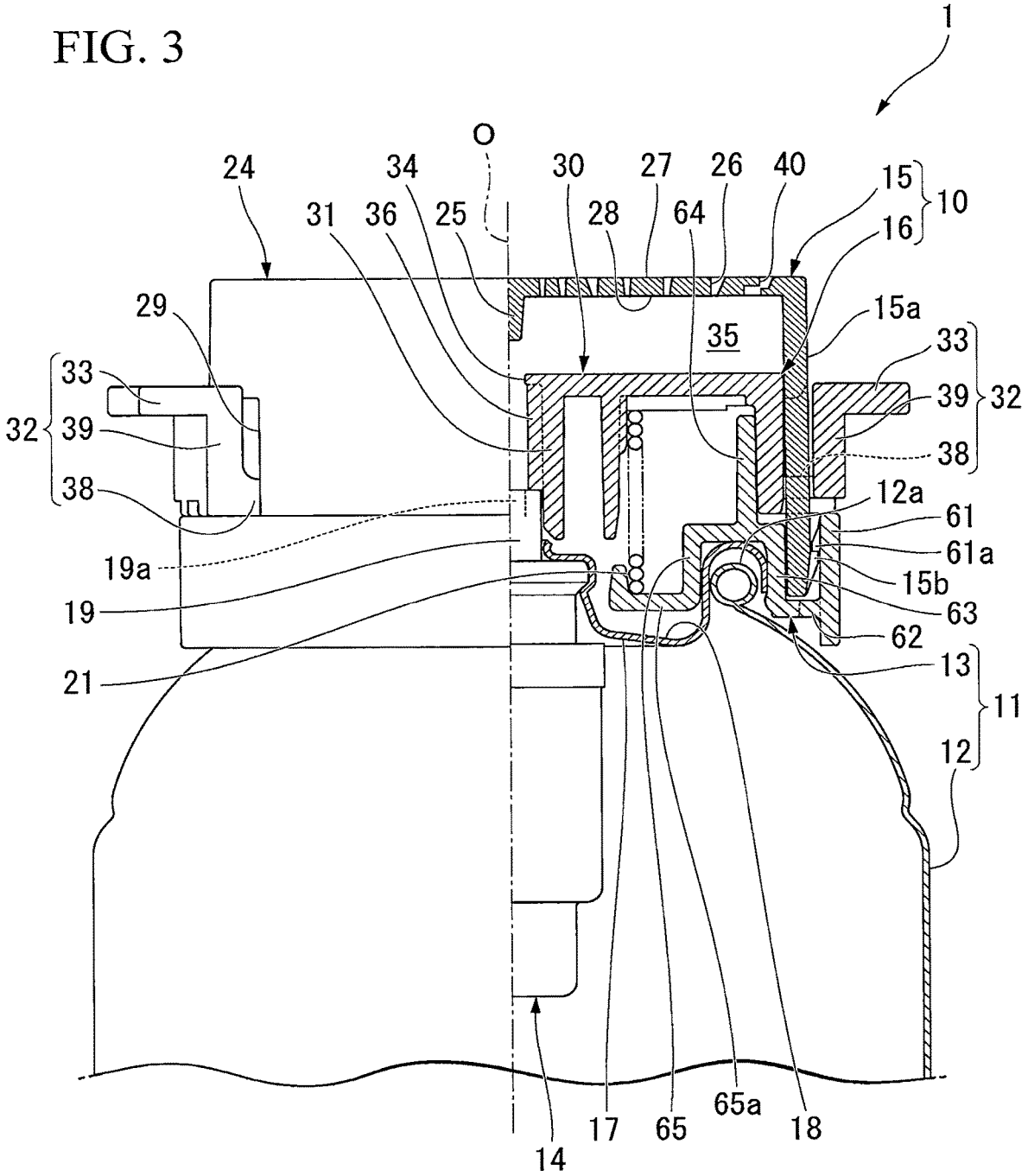
FIG. 3 is a partial longitudinal sectional view of the discharge container illustrated in FIG. 1, and the diagram illustrates a state in which the inner plate is lowered to a discharge position.

The inner plate 16 has the inner plate main body 30 which is formed to have a lidded cylinder shape and is fitted into the outer casing unit 15 in a vertically slidable manner, and push-down portions 32 which protrude outward in the radial direction from the outer casing unit 15. The inner plate 16 vertically moves between a standby position on an upper side as illustrated in FIG. 1 where a ceiling of the inner plate main body 30 is in contact with or close to the supply surface 28, and a discharge position on a lower side as illustrated in FIG. 3 where the ceiling of the inner plate main body 30 is downwardly separated from the supply surface 28, the dispersion chamber 35 is formed, and the stem 19 is lowered such that a content from the upper end opening portion 19*a* of the stem 19 is supplied to the inside of the dispersion chamber 35.

The dispersion chamber 35 is disposed coaxially with the container axis O. The dispersion chamber 35 is formed to have a flat shape larger in the radial direction than in the vertical direction. A part of a wall surface of the dispersion chamber 35 is formed by the supply surface 28, and the ceiling of the inner plate main body 30.

The communication hole 34 penetrated in the vertical direction is formed in the ceiling of the inner plate main body 30. The communication hole 34 is disposed coaxially with the container axis O. The core body 25 of the outer casing unit 15 is inserted into the communication hole 34. The inner diameter of the communication hole 34 is smaller than the outer diameter of the stem 19. As illustrated in FIG. 3, when the inner plate 16 is positioned at the discharge position, the communication hole 34 causes the inside of the stem 19 and the dispersion chamber 35 to communicate with each other, the inner plate main body 30 is positioned below the core body 25, and the core body 25 protrudes into the dispersion chamber 35.

In the circumferential opening edge portion of the communication hole 34 in the ceiling of the inner plate main body 30, a plurality of interlock portions 36 extending downward are formed at intervals in the circumferential direction. The interlock portions 36 lower the stem 19 as the lower end portions of the interlock portions 36 are interlocked with the upper end opening edge of the stem 19 in accordance with the inner plate 16 being lowered.

A guide cylinder 31 which is disposed coaxially with the container axis O and extends downward is formed in the ceiling of the inner plate main body 30. Outer end edges in the radial direction of the plurality of interlock portions 36 are connected to the inner circumferential surface of the guide cylinder 31. When the inner plate 16 is lowered, an upper end portion of the stem 19 enters the inside of the lower end portion of the guide cylinder 31. The inner circumferential surface of the lower end portion of the guide cylinder 31 gradually increases in diameter while going downward. Accordingly, when the inner plate 16 is lowered, the stem 19 smoothly enters the inside of the guide cylinder 31.

The push-down portion 32 includes a side plate 39 of which front and rear surfaces extend along the outer circumferential surface of the outer casing unit 15, a push-down plate 33 which protrudes outward in the radial direction from the side plate 39 and of which front and rear surfaces are directed in the vertical direction, and a joining plate 38 which joins the side plate 39 and the inner plate main body 30 to each other and is inserted through the insertion hole 29 of the outer casing unit 15.

Two push-down portions 32 are installed and are individually disposed, on the outer circumferential surface of the inner plate main body 30, at positions where the container axis O is sandwiched therebetween in the radial direction.

The joining plate 38 protrudes outward in the radial direction from the outer circumferential surface of the lower end portion of the inner plate main body 30. A plurality (two, in the illustrated example) of joining plates 38 are disposed at intervals in the circumferential direction for one side plate 39. From the upper side of the inner plate 16, the insertion wall portion 15*c* of the outer casing unit 15 is inserted into a gap between the joining plates 38 adjacent to each other in the circumferential direction through a gap in the radial direction between the side plate 39 and the outer circumferential surface of the inner plate main body 30. Therefore, the lower engagement portions 15*b* formed in the circumferential wall portion 15*a* of the outer casing unit 15 are disposed, on the outer circumferential surface of the circumferential wall portion 15*a*, at positions avoiding the positions where the push-down portions 32 are installed in the circumferential direction. The joining plate 38 is in contact with or close to an upper end edge of the circumferential opening edge portion of the insertion hole 29 which is positioned at the upper end and is directed downward. The joining plate 38 is in contact with or close to side edges of the circumferential opening edge portion of the insertion hole 29 which are positioned at both ends in the circumferential direction and are directed in the circumferential direction. Therefore, rotational movement of the inner plate 16 with respect to the outer casing unit 15 is restricted.

The joining plate 38 is joined to the lower end portion of the side plate 39, and the push-down plate 33 is joined to the upper end portion of the side plate 39. A gap in the radial direction is provided between the side plate 39 and the outer circumferential surface of the inner plate main body 30.

An upper surface of the push-down plate 33 is positioned below the molding surface 27 of the outer casing unit 15. The upper surface of the push-down plate 33 may be flush with the molding surface 27.

Here, as illustrated in FIG. 5, the length of the push-down portion 32 in the circumferential direction is larger than the length of the connection portion 62 of the fixing member 13 in the circumferential direction. The positions in the circumferential direction of the end portion of the push-down portion 32 in the circumferential direction and the end portion, in the circumferential direction, of a part where the lower engagement portion 15*b* and the upper engagement portion 61*a* engage with each other are adjacent to each other. The push-down portion 32 is installed at a position overlapping, in the vertical direction, at least a part of one of the plurality of connection portions 62 of the fixing member 13. In the illustrated example, a middle portion of the push-down portion 32 in the circumferential direction and a middle portion of one of the plurality of connection portions 62 in the circumferential direction overlap each other in the vertical direction. The middle portion of the push-down portion 32 in the circumferential direction and the middle portion of one of the plurality of connection portions 62 in the circumferential direction do not have to overlap each other in the vertical direction, as long as the push-down portion 32 and at least a part of one of the plurality of connection portions 62 overlap each other in the vertical direction.

As illustrated in FIGS. 1 and 3, the biasing member 21, for example, a coil spring, is installed between the fixing member 13 and the inner plate 16. The biasing member 21 is installed in a gap in the vertical direction between the container body 11 and the inner plate 16. When the inner plate 16 is positioned at the discharge position, the biasing member 21 is compressed in the vertical direction in a state in which the lower end portion of the biasing member 21 is in contact with the upper surface of the receiving plate portion 65*a* of the fixing member 13 and the upper end portion of the biasing member 21 is in contact with the lower surface of the inner plate main body 30. Accordingly, the biasing member 21 upwardly biases the inner plate 16 positioned at the discharge position. When a metal coil spring is used as the biasing member, a sufficient upward biasing force can be applied to the inner plate 16, so that a content inside the dispersion chamber 35 (which will be described below) can be reliably pushed out to the molding surface 27.

Next, operations of the discharge container 1 according to the present embodiment will be described.

First, when the inner plate 16 is lowered by pushing down the push-down plate 33 against a biasing force of the biasing member 20, the interlock portions 36 of the inner plate 16 are interlocked with the upper end opening edge of the stem 19. Moreover, when the inner plate 16 is continuously lowered, the stem 19 is lowered against the upward biasing force due to the interlock portions 36, so that a content inside the container main body 12 flows into the dispersion chamber 35 through the upper end opening portion 19*a* of the stem 19 and the communication hole 34. A content which has flowed into the dispersion chamber 35 moves on the outer circumferential surface of the core body 25 in the vertical direction and is retained on the core body 25. At this time, for example, a content retained on the core body 25 forms a circular shape about the core body 25 in plan view. When the amount of a content supplied to the core body 25 increases in accordance with increase in discharge amount of the content from the stem 19, the content grows on the core body 25 and gradually expands outward in the radial direction. Further, the dispersion chamber 35 is formed to have a flat shape as described above. Therefore, a content supplied to the inside of the dispersion chamber 35 is dispersed in the radial direction and is supplied to the plurality of shaping holes 26. A content which has flowed into the shaping holes 26 collides with the lower end surface of the first inner protrusion portion 40*a* and flows toward the guide surface 26*b* along the upper end surface of the second inner protrusion portion 41. Thereafter, the content flows toward the molding surface 27 along the guide surface 26*b*. Then, the content which has passed through the plurality of shaping holes 26 is discharged to the molding surface 27 and forms a plurality of molding pieces. The molding pieces are combined to form a molded article. Thereafter, when the push-down operation of the push-down plate 33 is released, the stem 19 is displaced upward in a restoring manner and the inner plate 16 is displaced upward in a restoring manner due to the biasing member 21, so that the ceiling of the inner plate main body 30 comes into contact with or close to the supply surface 28 of the outer casing unit 15. Accordingly, the inner volume of the dispersion chamber 35 is reduced or no longer exists, so that a content which has remained in the dispersion chamber 35 is discharged from the dispersion chamber 35 to the molding surface 27 through the shaping holes 26.

As described above, according to the discharge container 1 of the present embodiment, the first inner protrusion portion 40*a* is formed in the outer casing unit 15. Therefore, a content which has flowed into the dispersion chamber 35 from the upper end opening portion 19*a* of the stem 19 can be introduced to the openings of the shaping holes 26 on the molding surface 27 side by causing the content to collide with the lower end surface of the first inner protrusion portion 40*a*, so that the accuracy of forms such as the shape, the posture, and the size of molding pieces discharged from the shaping holes 26 to the molding surface 27 can be improved. Therefore, for example, even with a shaping hole, of the plurality of shaping holes 26, having difficulty in forming molding pieces with high accuracy, such as a shaping hole positioned far away from the upper end opening portion 19*a* of the stem 19, or a shaping hole having a long hole shape extending in a sharply curved manner, molding pieces can be formed with high accuracy. Accordingly, forms of molding pieces can be easily adjusted while the accuracy is maintained, regardless of the distance from the upper end opening portion 19*a* of the stem 19, the shape, the size, and the like of the shaping holes 26, so that various types of molded article can be easily formed with high accuracy.

In addition, the shaping hole 26 has the guide surface 26*b* of which at least the end portion on the molding surface 27 side extends gradually away from the facing surface 26*a* while going from the supply surface 28 side toward the molding surface 27 side in the longitudinal sectional view. Therefore, when a content is discharged through the shaping holes 26 to the molding surface 27, the content is introduced in a direction away from the facing surface 26*a*, such that molding pieces can extend upward in a state of being inclined with respect to the molding surface 27 in a direction away from the facing surface 26*a*, without causing the molding pieces to extend in a straight line upward from the molding surface 27. Accordingly, it is possible to accurately form molding pieces extending upward in a state of being inclined with respect to the molding surface 27.

In addition, at least the end portion of the guide surface 26*b* on the molding surface 27 side has a protruding curved line shape in the longitudinal sectional view. Therefore, for example, even if the shaping holes 26 have a complicated shape such as a long hole shape extending in a sharply curved manner, it is possible to accurately form molding pieces extending upward in a state of being inclined with respect to the molding surface 27.

In addition, the first inner protrusion portion 40*a* protrudes from the facing surface 26*a* toward the guide surface 26*b* in the longitudinal sectional view. Therefore, by causing a content which has flowed into the shaping holes 26 from the dispersion chamber 35 to collide with the lower end surface of the first inner protrusion portion 40*a*, the content can be directed to the guide surface 26*b* and can be separated from the facing surface 26*a*. At this time, at least the end portion of the guide surface 26*b* on the molding surface 27 side extends gradually away from the facing surface 26*a* while going from the supply surface 28 side toward the molding surface 27 side. Therefore, a content which has been introduced from the first inner protrusion portion 40*a* to the guide surface 26*b* side can be smoothly introduced to the openings of the shaping holes 26 on the molding surface 27 side.

In addition, the second inner protrusion portion 41 which protrudes toward the facing surface 26*a* is formed in a part of the guide surface 26*b* positioned below the first inner protrusion portion 40*a* in the longitudinal sectional view. Therefore, even if a part of a content which has collided with the lower end surface of the first inner protrusion portion 40*a* tends to flow back downward, the second inner protrusion portion 41 can block the flow-back and introduce the part of the content to the guide surface 26*b*, so that a content which has been introduced from the first inner protrusion portion 40*a* to the guide surface 26*b* side can be more smoothly introduced toward the openings of the shaping holes 26 on the molding surface 27 side.

In addition, the opening area of the shaping hole 26 on the molding surface 27 side is smaller than the opening area thereof on the supply surface 28 side. Therefore, a content in the dispersion chamber 35 can easily flow into the shaping holes 26 while distortion of molding pieces is prevented, so that molding pieces can be reliably formed with high accuracy even with the shaping hole 26 into which a content from the dispersion chamber 35 does not easily flow.

In addition, the shaping holes 26 are long holes extending in the circumferential direction. The first inner protrusion portion 40*a* is formed on the facing surface 26*a* extending in the circumferential direction or in a part, of the circumferential opening edge portion of the shaping hole 26 on the supply surface 28 side, connected to the guide surface 26*b* extending in the circumferential direction. Therefore, even with a long hole into which a content from the dispersion chamber 35 does not easily flow, molding pieces can be formed with high accuracy by causing the content to pass through this long hole.

In addition, since the joining plates 38 of the push-down portions 32 are in contact with or close to the upper end edge of the circumferential opening edge portion of the insertion hole 29, when the push-down portions 32 are raised, the outer casing unit 15 is also raised, so that the lower engagement portions 15*b* of the outer casing unit 15 are caught by the upper engagement portions 61*a* of the fixing member 13 from the lower side of the upper engagement portions 61*a*. Accordingly, raising forces applied to the push-down portions 32 are transferred to the external fitting cylinder 63 via the connection portions 62 of the fixing member 13, so that a significant local force directed outward in the radial direction is applied to connection parts of the external fitting cylinder 63 with the connection portions 62. Therefore, the external fitting cylinder 63 can be deformed throughout the whole circumference while having the connection parts as origins, so that the fixing member 13 can be detached from the mouth portion of the container main body 12. Accordingly, for example, after a content inside the container main body 12 is exhausted, the container main body 12 can be replaced by detaching the outer casing unit 15 and the inner plate 16 from the container main body 12 together with the fixing member 13 as necessary.

In addition, the lower engagement portions 15*b* are disposed, on the outer circumferential surface of the circumferential wall portion 15*a* of the outer casing unit 15, at positions in the circumferential direction avoiding the positions where the push-down portions 32 are installed. Therefore, when the inner plate 16 is assembled in the outer casing unit 15, the lower engagement portions 15*b* of the outer casing unit 15 can be prevented from interfering with the push-down portions 32.

In addition, the push-down portions 32 which are pushed down when a content is discharged are provided in the inner plate 16 separately from the outer casing unit 15 having the molding surface 27 on which a content is discharged. Therefore, a content can be discharged without touching the molding surface 27 of the outer casing unit 15, so that a content can be prevented from adhering to a hand, and shaking of the outer casing unit 15 can be prevented. Accordingly, it is possible to prevent distortion of a molded article on the molding surface 27 and falling of a part of a molded article from the molding surface 27.

In addition, a content inside the container body 11 is dispersed in the radial direction inside the dispersion chamber 35, and then is supplied to the shaping holes 26. Therefore, concentration of a content in some of the shaping holes 26 disposed at a particular place on the molding surface 27 is prevented, so that a content can be evenly supplied to the plurality of shaping holes 26. Accordingly, it is possible to prevent the variation in discharge amount of a content to the molding surface 27 according to the position, so that a molded article can be accurately formed.

In addition, the lower engagement portion 15*b* extending in the circumferential direction is divided by the insertion hole 29 through which the push-down portion 32 of the inner plate 16 is inserted, and the positions in the circumferential direction of the end portion of the push-down portion 32 in the circumferential direction and the end portion, in the circumferential direction, of a part where the lower engagement portion 15*b* and the upper engagement portion 61*a* engage with each other are adjacent to each other. Therefore, a raising force applied to the push-down portions 32 can be directly transmitted to the part where the lower engagement portion 15*b* and the upper engagement portion 61*a* engage with each other, without being dispersed on the circumferential wall portion 15*a* of the outer casing unit 15, so that a significant local force directed outward in the radial direction can be effectively applied to a connection part between the external fitting cylinder 63 and the connection portion 62.

In addition, at least a part of one of the plurality of connection portions 62 overlaps the push-down portions 32 in the vertical direction. Therefore, raising forces applied to the push-down portions 32 are likely to be preferentially transmitted to the one of the plurality of connection portions 62, so that a significant local force directed outward in the radial direction can be easily applied to the connection part between the external fitting cylinder 63 and the connection portion 62.

In addition, in plan view when viewed in the vertical direction, the upper engagement portion 61*a* is positioned on the inner side of the gap between the connection portions 62 adjacent to each other in the circumferential direction, so that the upper engagement portions 61*a* and the connection portions 62 do not overlap each other in plan view when viewed in the vertical direction. Therefore, when forming the fixing member 13 having the connection portions 62 and the upper engagement portions 61*a*, only the vertical direction can be set to a direction of withdrawing a mold. Accordingly, the fixing member 13 can be easily formed without having a complicated mold structure.

In addition, the lower engagement portion 15*b* is not formed in the insertion wall portion 15*c*, of the circumferential wall portion 15*a* of the outer casing unit 15, positioned between the insertion holes 29 adjacent to each other in the circumferential direction. Therefore, even if the gap in the radial direction between the outer circumferential surface of the inner plate main body 30 and the side plate 39 is not widened, the insertion wall portion 15*c* can be smoothly inserted between the joining plates 38 of the inner plate 16 adjacent to each other in the circumferential direction.

Next, a second embodiment of the present invention will be described.

In this second embodiment, the same reference signs are applied to the same parts as the constituent elements in the first embodiment. Description thereof will be omitted, and only the differences will be described.

Figure 8:
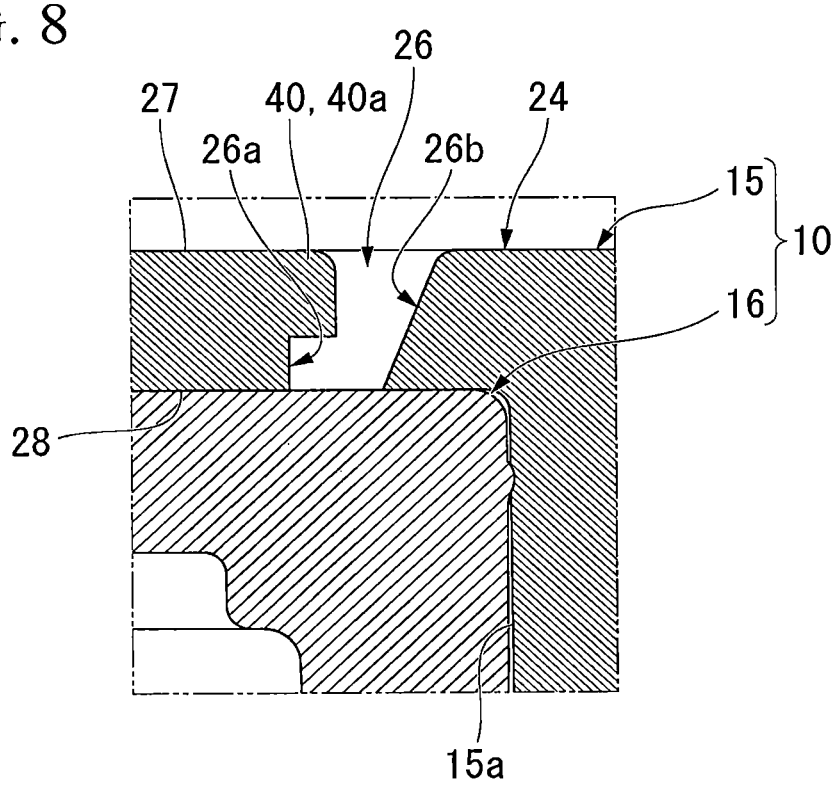
FIG. 8 is an enlarged view of a main part of a discharge container according to a second embodiment of the present invention.

In the shaping holes 26 of the present embodiment, as illustrated in FIG. 8, the second inner protrusion portion 41 is not formed on the guide surface 26*b*, and in the longitudinal sectional view, the guide surface 26*b* extends in a linear shape gradually away from the facing surface 26*a* throughout the whole region while going from the supply surface 28 side toward the molding surface 27 side. In addition, in this shaping hole 26, the opening area on the molding surface 27 side is equal to or larger than the opening area on the supply surface 28 side. The length of the first inner protrusion portion 40*a* in the vertical direction is equal to or larger than half the length of the shaping hole 26 in the vertical direction. In the longitudinal sectional view, the length of the distal end surface of the first inner protrusion portion 40*a* is equal to or larger than the length of the lower end surface of the first inner protrusion portion 40*a*.

As described above, according to the present embodiment, the first inner protrusion portion 40*a* is formed in the outer casing unit 15, and the shaping hole 26 has the guide surface 26*b*. Therefore, similar to the first embodiment, various types of molded article can be easily formed with high accuracy, and it is possible to accurately form molding pieces extending upward in a state of being inclined with respect to the molding surface 27.

Next, a third embodiment of the present invention will be described.

In this third embodiment, the same reference signs are applied to the same parts as the constituent elements in the second embodiment. Description thereof will be omitted, and only the differences will be described.

Figure 9:
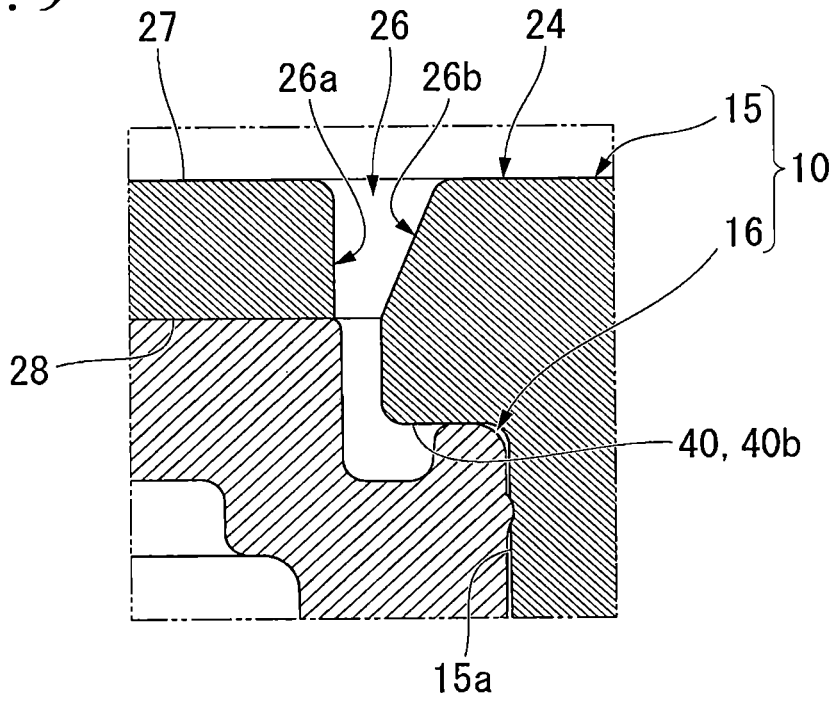
FIG. 9 is an enlarged view of a main part of a discharge container according to a third embodiment of the present invention.

In the shaping holes 26 of the present embodiment, as illustrated in FIG. 9, the guide protrusion portion 40 includes an outer protrusion portion 40*b* which protrudes downward from a part, of the circumferential opening edge portion of the shaping hole 26 on the supply surface 28 side, connected to the guide surface 26*b* of this shaping hole 26 in the longitudinal sectional view. The length of the outer protrusion portion 40*b* in the vertical direction is equivalent to the length of the shaping hole 26 in the vertical direction. The outer protrusion portion 40*b* is formed to have an annular shape disposed coaxially with the container axis O and is formed integrally with the inner circumferential surface of the circumferential wall portion 15*a* and the supply surface 28 of the top wall portion 24 in the outer casing unit 15. Accordingly, the dispersion chamber 35 includes a small-diameter space which has the inner circumferential surface of the outer protrusion portion 40*b* and the supply surface 28 as a wall surface, and a large-diameter space which is positioned below the outer protrusion portion 40*b*. The inner circumferential surface of the outer protrusion portion 40*b* is connected to the guide surface 26*b* with no step.

The first inner protrusion portion 40*a* is not formed on the facing surface 26*a*, and in the longitudinal sectional view, the facing surface 26*a* extends in a straight line in the vertical direction throughout the whole region in the vertical direction.

As described above, according to the present embodiment, the guide protrusion portion 40 includes the outer protrusion portion 40*b*. Therefore, a content which has moved in the dispersion chamber 35 in the radial direction and has arrived at the circumferential opening edge portions of the shaping holes 26 on the supply surface 28 side can be directed upward and introduced into the shaping holes 26 by causing the content to collide with the outer protrusion portion 40*b*, so that a content can be smoothly introduced to the openings of the shaping holes 26 on the molding surface 27 side. Accordingly, various types of molded article can be easily formed with high accuracy. In addition, the shaping hole 26 has the guide surface 26*b*. Therefore, similar to the first embodiment, molding pieces extending upward can be accurately formed in a state of being inclined with respect to the molding surface 27.

Next, a fourth embodiment of the present invention will be described.

In this fourth embodiment, the same reference signs are applied to the same parts as the constituent elements in the third embodiment. Description thereof will be omitted, and only the differences will be described.

Figure 10:
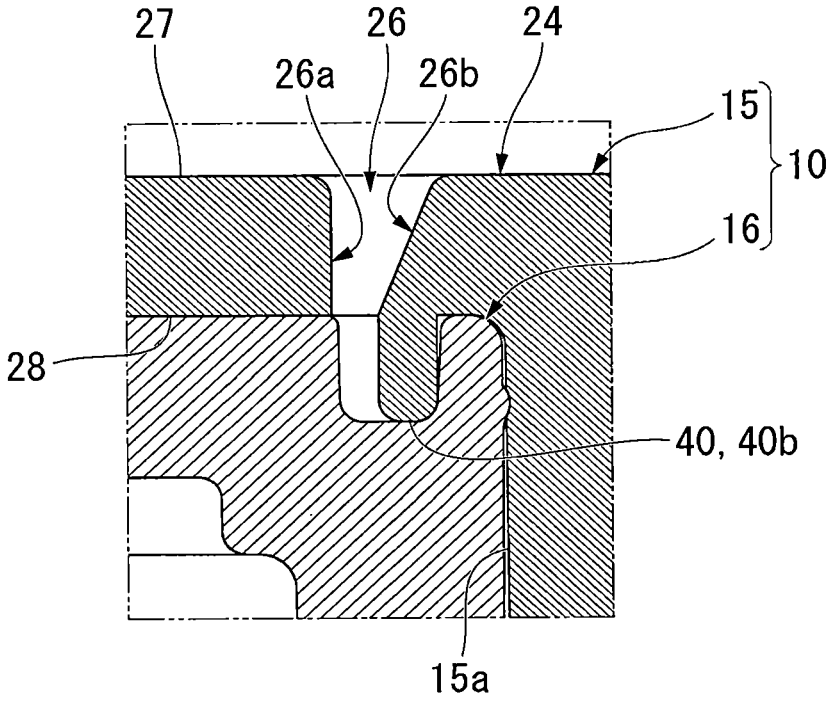
FIG. 10 is an enlarged view of a main part of a discharge container according to a fourth embodiment of the present invention.

In the shaping holes 26 of the present embodiment, as illustrated in FIG. 10, the outer protrusion portion 40*b* is separated inward in the radial direction from the inner circumferential surface of the circumferential wall portion 15*a* of the outer casing unit 15.

As described above, according to the present embodiment, the guide protrusion portion 40 includes the outer protrusion portion 40*b*, and the shaping hole 26 has the guide surface 26*b*. Therefore, similar to the third embodiment, various types of molded article can be easily formed with high accuracy, and it is possible to accurately form molding pieces extending upward in a state of being inclined with respect to the molding surface 27.

The technical scope of the present invention is not limited to the foregoing embodiments, and various changes can be added within a range not departing from the gist of the present invention.

The foregoing embodiments may be suitably combined. For example, the first embodiment may adopt a configuration in which the guide protrusion portion 40 includes both the first inner protrusion portion 40*a* and the outer protrusion portion 40*b*.

Figure 11:
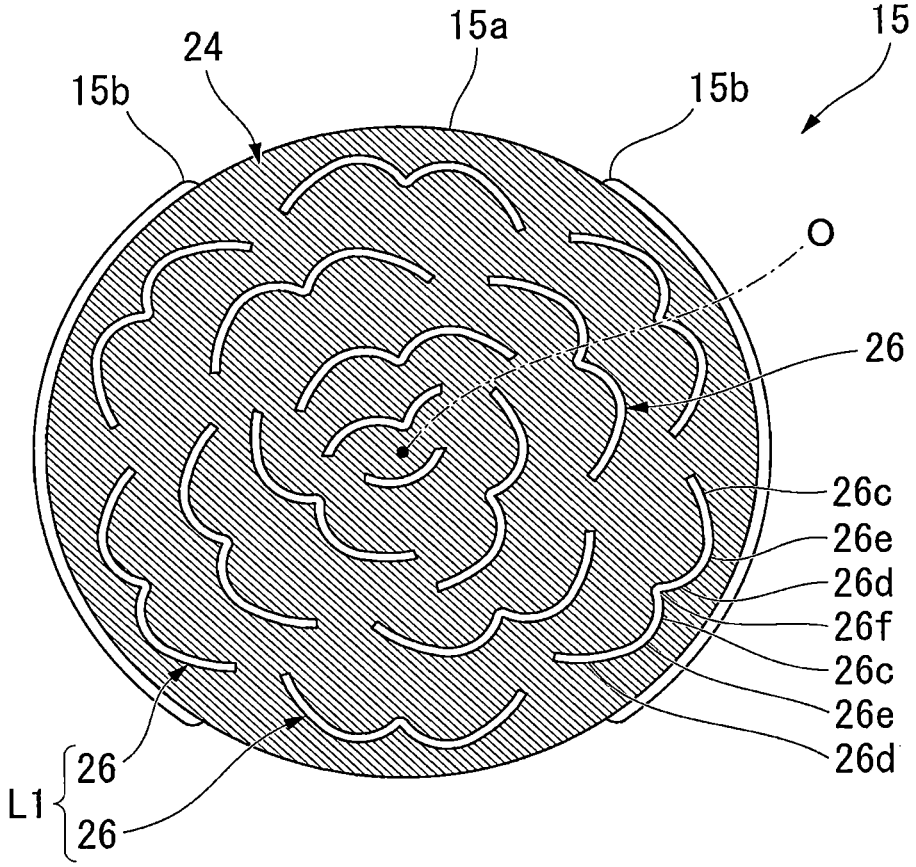
FIG. 11 is a cross-sectional view of a top wall portion of an outer casing unit of a discharge container in a first modification example of the first to fourth embodiments of the present invention.

The shaping holes 26 are not limited to the foregoing embodiments. For example, shaping holes 26 as in a first modification example illustrated in FIG. 11 may be employed. In a cross-sectional view of the top wall portion 24 of the outer casing unit 15 orthogonal to the container axis O, the shaping holes 26 is formed to have a sharply curved long hole shape in its entirety in which a first part 26*c* which extends in a first direction and a second part 26*d* which extends in a second direction different from the first direction are joined to each other via a first curved portion 26*e*. In the illustrated example, in the cross-sectional view, the shaping hole 26 has an M-shape in which long holes each having the first part 26*c*, the second part 26*d*, and the first curved portion 26*e* are connected to each other via a second curved portion 26*f* which is curved in a direction opposite to the first curved portion 26*e*.

In the shaping holes 26, although it is particularly difficult to cause molding pieces to have an inclined posture on the molding surface 27, since the guide protrusion portion 40 is installed in the top wall portion 24 of the outer casing unit 15, a content can be introduced from the dispersion chamber 35 to the openings of the shaping holes 26 on the molding surface 27 side as described above, so that even a molded article having an inclined posture can be formed with high accuracy.

Although the foregoing embodiments have illustrated a configuration in which a content is discharged from the upper end opening portion 19*a* of the stem 19 when the push-down plates 33 are pushed down, the embodiments are not limited thereto and may be suitably changed. For example, a configuration as in a second modification example illustrated in FIGS. 12 to 15 may be employed.

The fixing member 13 of the second modification example includes the external fitting cylinder 63, an annular joint portion 23 which extends inward in the radial direction from the upper end portion of the external fitting cylinder 63, an inner cylinder portion 22 which extends downward from an inner circumferential edge of the joint portion 23, an annular receiving portion 54 which extends inward in the radial direction from a lower end portion of the inner cylinder portion 22, and an outer conversion cylinder portion 55 which extends upward from an inner circumferential edge of the receiving portion 54.

Fitting protrusion portions 63*a* protruding inward in the radial direction are formed in the lower end portion of the external fitting cylinder 63. A plurality of fitting protrusion portions 63*a* are formed at intervals in the circumferential direction (refer to FIG. 13). As the fitting protrusion portions 63*a* are undercut-fitted to the outer circumferential edge portion of the top plate 17 and the external fitting cylinder 63 is externally fitted to the mouth portion 12*a*, rotational movement of the fixing member 13 around the container axis O and rising movement of the fixing member 13 are restricted. In plan view, the external fitting cylinder 63 has a circular shape disposed coaxially with the container axis O. A flange portion 63*b* protruding outward in the radial direction is formed in a middle portion of the external fitting cylinder 63 in the vertical direction. An enclosing cylinder portion 63*c* extending downward is formed at the outer circumferential edge of the flange portion 63*b*.

The lower end portion of the biasing member 21 is in contact with the upper surface of the receiving portion 54.

The joint portion 23 joins the upper end portions of the inner cylinder portion 22 and the external fitting cylinder 63 to each other.

The joint portion 23 straddles the upper end opening edge of the mouth portion 12*a* of the container main body 12 in the radial direction. Penetration holes 23*a* penetrating the joint portion 23 in the vertical direction are formed in the joint portion 23. A plurality of penetration holes 23*a* are formed at equal intervals in the circumferential direction (refer to FIG. 13). A fitting cylinder portion 23*b* extending upward is formed at the outer circumferential edge of the joint portion 23. The fitting cylinder portion 23*b* is positioned on the outer side of the external fitting cylinder 63 in the radial direction and is positioned on the inner side of the enclosing cylinder portion 63*c* in the radial direction. A fitting target portion 23*c* protruding outward in the radial direction is formed on the outer circumferential surface of the fitting cylinder portion 23*b* throughout the whole circumference.

The inner cylinder portion 22 is positioned inside the annular recess portion 18 of the top plate 17 and is fixed to the outer circumferential surface of the annular recess portion 18 directed inward in the radial direction, from the inner side in the radial direction.

The inner plate 16 includes a plate-shaped plate main body 130 which extends within a plane orthogonal to the container axis O, and an inner conversion cylinder portion 132 which extends downward from the plate main body 130 and is disposed coaxially with the container axis O. The inner conversion cylinder portion 132 encloses the guide cylinder 31 formed in the plate main body 130 from the outside in the radial direction. The lower end portion of the inner conversion cylinder portion 132 is positioned below the lower end portion of the guide cylinder 31.

The plate main body 130 is fitted into the outer casing unit 15, and the outer circumferential edge of the plate main body 130 slides on the inner circumferential surface of the outer casing unit 15 in the vertical direction. The upper surface of the plate main body 130 is in contact with or close to the supply surface 28 of the outer casing unit 15 due to an upward biasing force of the biasing member 21. In plan view, the plate main body 130 and the supply surface 28 are formed to have shapes and sizes equivalent to each other.

The outer diameter of the inner conversion cylinder portion 132 is smaller than the inner diameter of the outer conversion cylinder portion 55. The inner conversion cylinder portion 132 is installed on the inner side of the outer conversion cylinder portion 55. The lower end portion of the inner conversion cylinder portion 132 is positioned at a middle portion of the outer conversion cylinder portion 55 in the vertical direction.

Figure 15:
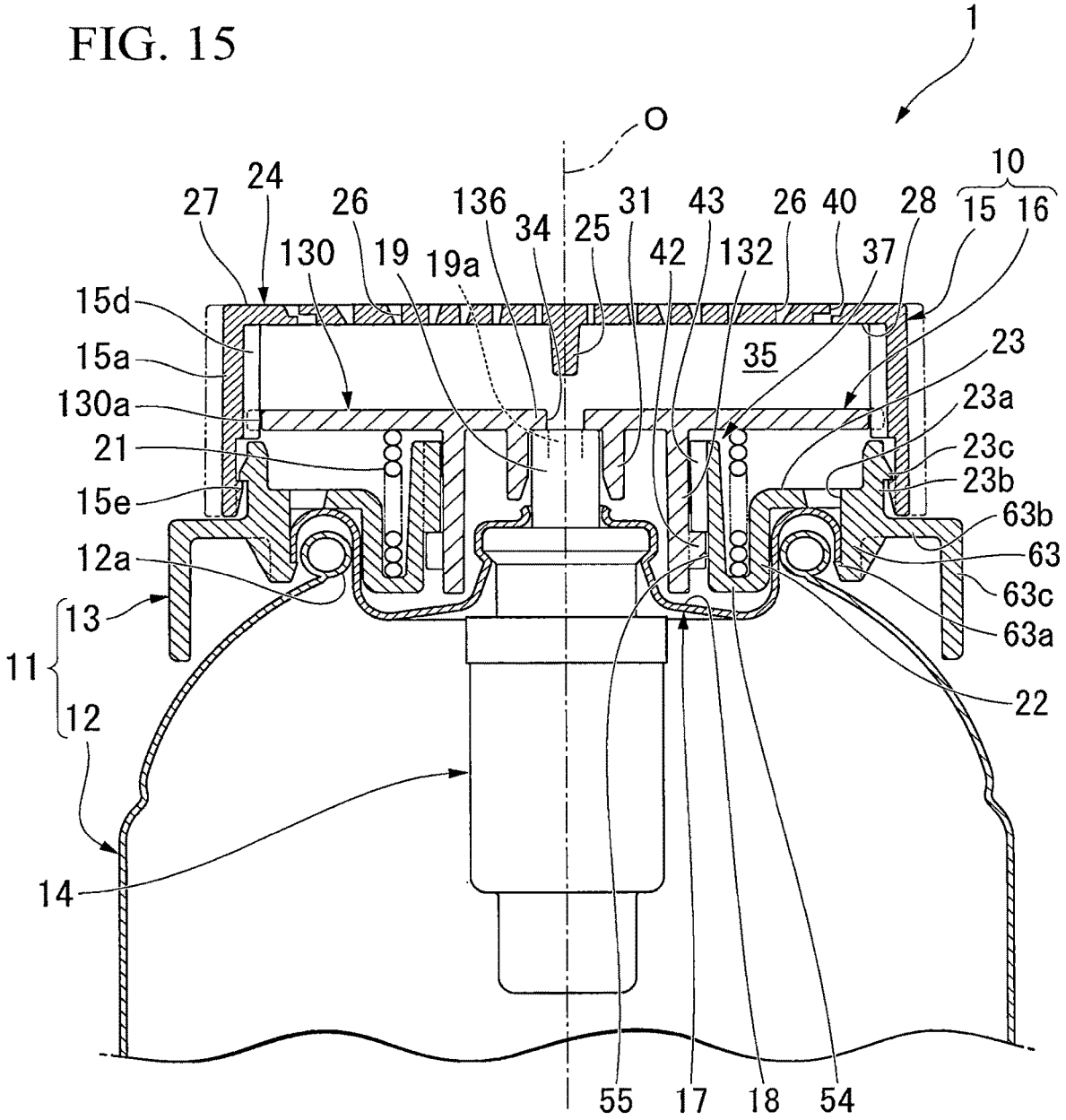
FIG. 15 is a partial longitudinal sectional view of the discharge container illustrated in FIG. 12, and the diagram illustrates a state in which the inner plate is positioned at a discharge position.

As illustrated in FIG. 15, when the inner plate 16 is positioned at the discharge position, a circumferential opening edge portion (which will hereinafter be referred to as an interlock portion 136) of the communication hole 34 in the plate main body 130 is interlocked with the stem 19. The interlock portion 136 comes into contact with the upper end opening edge of the stem 19 from above and lowers the stem 19 in accordance with the inner plate 16 being lowered.

Projection portions 15*d* protruding inward in the radial direction are formed on the inner circumferential surface of the circumferential wall portion 15*a* of the outer casing unit 15. A plurality of projection portions 15*d* extending in the vertical direction are formed at intervals in the circumferential direction. As recess portions 130*a* formed at the outer circumferential edge of the plate main body 130 of the inner plate 16 engage with the projection portions 15*d*, rotational movement of the plate main body 130 around the container axis O with respect to the outer casing unit 15 is restricted. Accordingly, the outer casing unit 15 and the inner plate 16 can integrally rotate around the container axis O. In the illustrated example, the projection portions 15*d* and the recess portions 130*a* are installed at positions facing each other with the container axis O sandwiched therebetween in the radial direction. Accordingly, the outer casing unit 15 and the inner plate 16 can reliably rotate in an integrated manner.

A configuration for causing the outer casing unit 15 and the inner plate 16 to integrally rotate is not limited to the projection portions 15*d* and the recess portions 130*a*. For example, the number of projection portions 15*d* and recess portions 130*a* may be suitably changed. Alternatively, a recess portion may be formed in the outer casing unit 15, and a projection portion engaging with this recess portion may be formed in the inner plate 16.

A fitting portion 15*e* protruding inward in the radial direction is formed in the lower end portion of the circumferential wall portion 15*a* of the outer casing unit 15. The fitting portion 15*e* is undercut-fitted to the fitting target portion 23*c* of the fixing member 13. Accordingly, upward movement of the outer casing unit 15 with respect to the fixing member 13 is restricted. In addition, the lower end opening edge of the outer casing unit 15 is in contact with or close to the upper surface of the flange portion 63*b* of the fixing member 13. Accordingly, downward movement of the outer casing unit 15 with respect to the fixing member 13 is restricted.

The discharge container 1 of the second modification example includes a conversion mechanism 37 which converts a rotative operation of the outer casing unit 15 and the inner plate 16 around the container axis O with respect to the container body 11 into an operation of the inner plate 16 in the vertical direction. The conversion mechanism 37 is constituted of slide protrusion portions 42 provided in either of the inner plate 16 or the container body 11, and guide protrusion portions 43 provided in the other thereof.

In the illustrated example, the slide protrusion portions 42 protrude outward in the radial direction from the outer circumferential surface of the inner conversion cylinder portion 132, and the guide protrusion portions 43 protrude inward in the radial direction from the inner circumferential surface of the outer conversion cylinder portion 55 of the container body 11. The guide protrusion portions 43 extend over an area from the upper end portion to a middle portion of the outer conversion cylinder portion 55 in the vertical direction. The upper end portions of the slide protrusion portions 42 are positioned on the lower side of the upper end portions of the guide protrusion portions 43.

Figure 14:
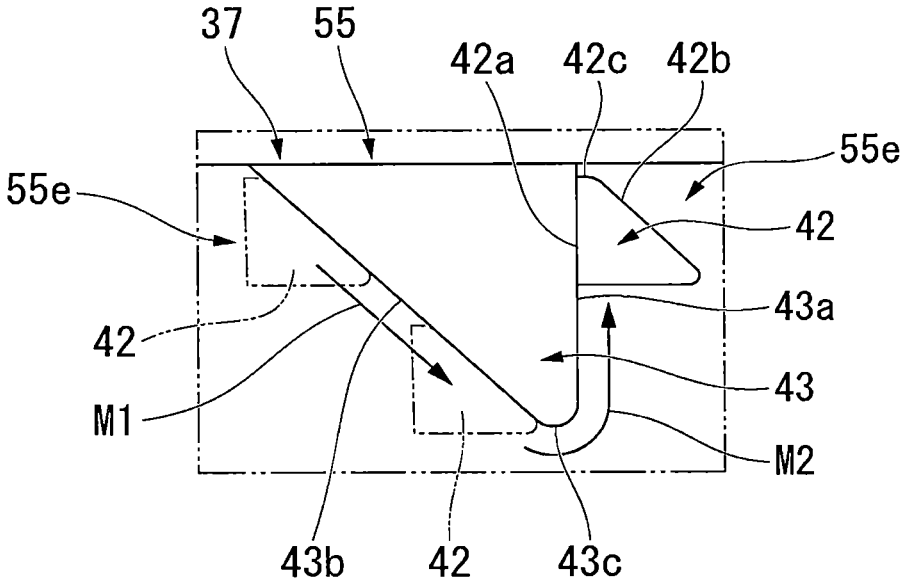
FIG. 14 is a development view of a conversion mechanism of the discharge container illustrated in FIG. 12.

As illustrated in FIG. 14, the guide protrusion portion 43 has a first perpendicular surface 43*a* which extends in the vertical direction, and a first inclined surface 43*b* which is gradually separated from the first perpendicular surface 43*a* to one side in the circumferential direction while going upward from the lower end portion of the first perpendicular surface 43*a*. The guide protrusion portion 43 is formed to have a substantially triangular shape with a corner portion protruding downward. The lower end of the first perpendicular surface 43*a* and the lower end of the first inclined surface 43*b* are connected to each other through a curved surface 43*c* protruding downward.

The slide protrusion portion 42 has a second perpendicular surface 42*a* which extends in the vertical direction, and a second inclined surface 42*b* which is gradually separated from the second perpendicular surface 42*a* to the other side in the circumferential direction while going downward from the upper end portion of the second perpendicular surface 42*a*. The slide protrusion portion 42 is formed to have a substantially triangular shape with a corner portion protruding upward. The upper end portion of the second inclined surface 42*b* is a curved surface 42*c* protruding upward.

The slide protrusion portion 42 in its entirety is smaller than the guide protrusion portion 43 and is formed to have a shape substantially similar to that of the guide protrusion portion 43. An angle formed by the first perpendicular surface 43*a* and the first inclined surface 43*b* and an angle formed by the second perpendicular surface 42*a* and the second inclined surface 42*b* are equivalent to each other.

Due to the first inclined surface 43*b* and the second inclined surface 42*b*, clockwise (to the other side in the circumferential direction) rotation of the inner plate 16 with respect to the container body 11 in plan view is allowed. In addition, due to the first perpendicular surface 43*a*, the second perpendicular surface 42*a*, and an upward biasing force of the biasing member 21 to the inner plate 16, counterclockwise (to one side in the circumferential direction) rotation of the inner plate 16 with respect to the container body 11 in plan view is restricted. In this manner, the slide protrusion portions 42, the guide protrusion portions 43, and the biasing member 21 constitute a ratchet mechanism which allows rotation of the inner plate 16 around the container axis O with respect to the container body 11 in only one direction.

This ratchet mechanism may have a configuration allowing counterclockwise rotation of the inner plate 16 with respect to the container body 11 in plan view and restricting clockwise rotation thereof.

Figure 12:
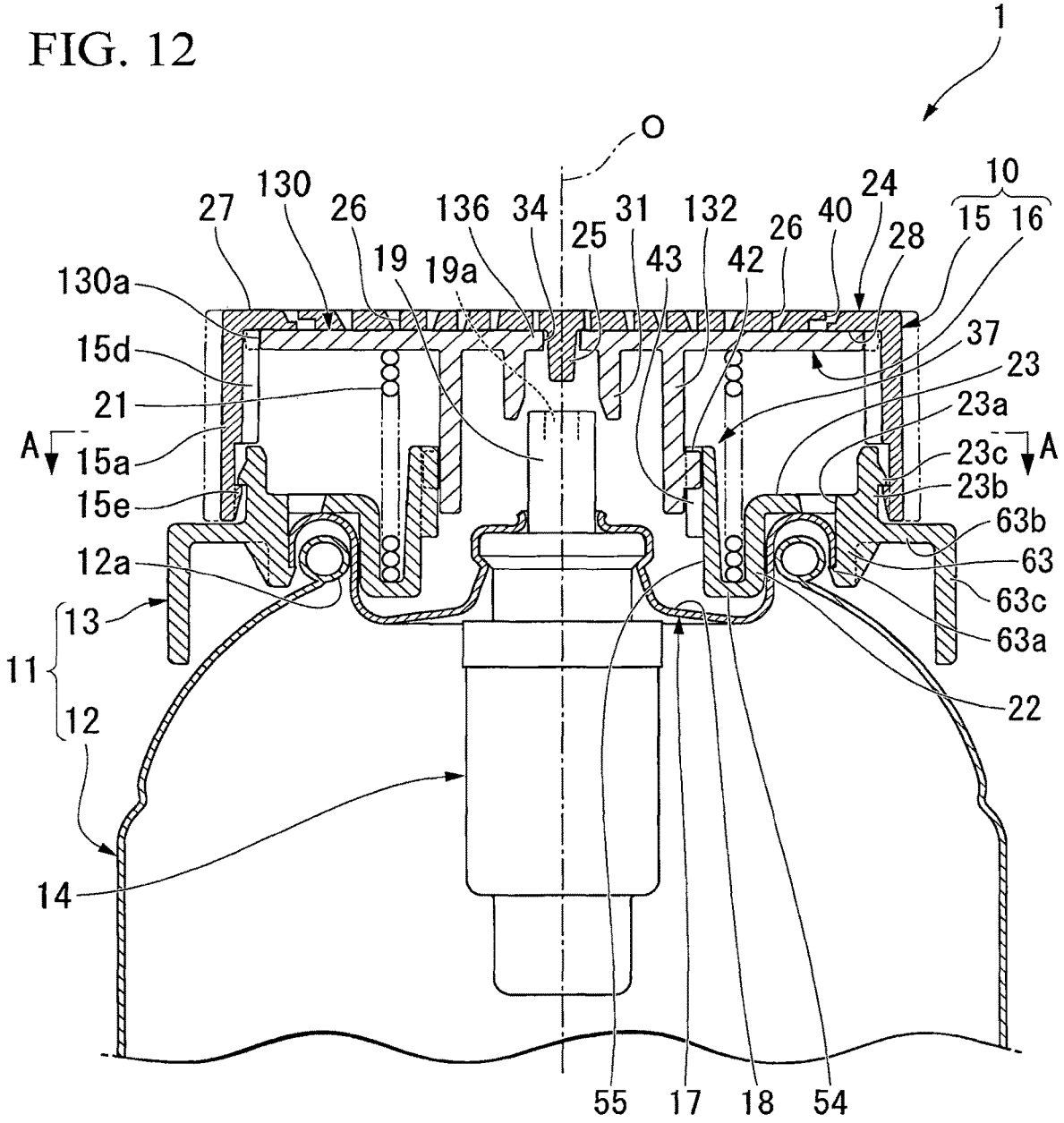
FIG. 12 is a partial longitudinal sectional view of a discharge container in a second modification example of the first to fourth embodiments of the present invention, and the diagram illustrates a state in which an inner plate is positioned at a standby position.
Figure 13:
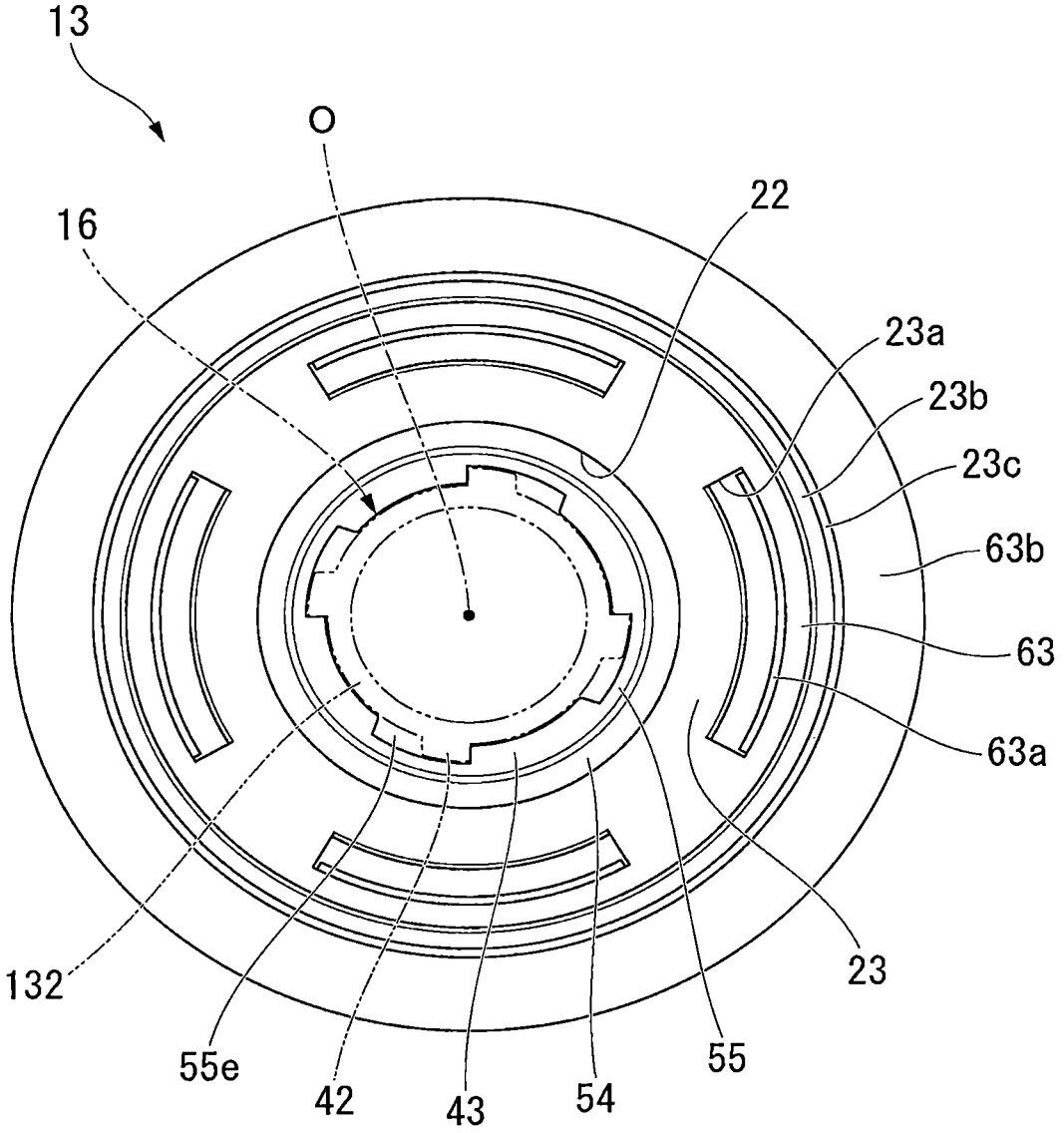
FIG. 13 is a plan view of a fixing member of the discharge container illustrated in FIG. 12.

FIG. 13 is a plan view of the fixing member 13, and a two-dot chained line indicates the shape of the inner plate 16 which is cut along line A-A illustrated in FIG. 12 and is viewed downward.

A plurality of guide protrusion portions 43 are formed on the inner circumferential surface of the outer conversion cylinder portion 55 at equal intervals in the circumferential direction. Accordingly, escape portions 55*e* are provided, at positions avoiding the guide protrusion portions 43, on the inner circumferential surface of the outer conversion cylinder portion 55. The escape portions 55*e* are installed on both sides of the guide protrusion portion 43 in the circumferential direction. The width of the escape portion 55*e* in the circumferential direction is larger than the width of the slide protrusion portion 42 in the circumferential direction. Therefore, in a state in which the slide protrusion portion 42 is positioned in the escape portion 55*e*, play in the circumferential direction is caused between the slide protrusion portion 42 and the guide protrusion portion 43. Accordingly, when an excessively significant rotation force is applied to the inner plate 16, a content can be prevented from being continuously discharged by, for example, restraining the slide protrusion portion 42 from continuously passing over some guide protrusion portions 43 in the circumferential direction.

A plurality of slide protrusion portions 42 are formed on the outer circumferential surface of the inner conversion cylinder portion 132 at equal intervals in the circumferential direction. The number of slide protrusion portions 42 is the same as that of the guide protrusion portions 43 (four, in the illustrated example).

The number of slide protrusion portions 42 does not have to be the same as that of the guide protrusion portions 43 and may be fewer than the guide protrusion portions 43, for example.

As illustrated in FIG. 13, in plan view, in a state in which the end portion of the slide protrusion portion 42 on one side in the circumferential direction and the end portion of the guide protrusion portion 43 on the other side in the circumferential direction are close to each other, the inclinations of these end portions substantially coincide with each other. Similarly, when the end portion of the slide protrusion portion 42 on the other side in the circumferential direction and the end portion of the guide protrusion portion 43 on one side in the circumferential direction are close to each other, the inclinations of these end portions substantially coincide with each other. Accordingly, the contact area between the first perpendicular surface 43*a* and the second perpendicular surface 42*a*, and the contact area between the first inclined surface 43*b* and the second inclined surface 42*b* can be increased.

Next, operations of the discharge container 1 constituted as described above will be described.

When the outer casing unit 15 is rotated toward the other side in the circumferential direction around the container axis O with respect to the container body 11, the inner plate 16 rotates integrally with the outer casing unit 15 around the container axis O with respect to the fixing member 13, and the first inclined surface 43*b* and the second inclined surface 42*b* come into contact with each other in the circumferential direction. When the outer casing unit 15 is further rotated continuously, as indicated with an arrow M1 in FIG. 14, the slide protrusion portions 42 are lowered along the first inclined surfaces 43*b*. Accordingly, the inner plate 16 is lowered against the upward biasing force of the biasing member 21, and the interlock portion 136 of the inner plate 16 lowers the stem 19. Then, while the inner volume of the dispersion chamber 35 between the inner plate 16 and the outer casing unit 15 is increased, a content is discharged to the molding surface 27 through the upper end opening portion 19*a* of the stem 19, the communication hole 34, the dispersion chamber 35, and the shaping holes 26.

When the outer casing unit 15 is further rotated continuously, as indicated with an arrow M2 in FIG. 14, the slide protrusion portions 42 reach the lower end portions of the first inclined surfaces 43*b* of the guide protrusion portions 43 and pass through the curved surfaces 43*c* to the other side in the circumferential direction, thereby arriving at the escape portions 55*e*. Since upward movement of the slide protrusion portions 42 is allowed at the escape portions 55*e*, the inner plate 16 rises to the standby position due to the upward biasing force of the biasing member 21.

When a content is discharged again, the operations described above are repeated by performing an operation of rotating the outer casing unit 15 in the same direction, so that a content can be repetitively discharged.

In the discharge container 1 constituted as described above, by performing an operation of rotating the outer casing unit 15 around the container axis O with respect to the container body 11, a content can be discharged from the upper end opening portion 19*a* of the stem 19, and the inner plate 16 can be displaced to the standby position in a restoring manner to stop this discharge. Accordingly, an operation force is reduced compared to, for example, a case in which a content is discharged from the upper end opening portion 19*a* of the stem 19 by pushing down the inner plate 16 with a hand. Accordingly, the discharge amount of a content can be stabilized, and a molded article can be molded with high accuracy as the flow of a content discharged to the molding surface 27 when the content is discharged from the upper end opening portion 19*a* of the stem 19, and the flow of a content discharged to the molding surface 27 when discharge of the content from the upper end opening portion 19*a* of the stem 19 is stopped and the content inside the dispersion chamber 35 is pushed out to the molding surface 27 are continuously performed.

In addition, the receiving portion 54 receiving an elastic force of the biasing member 21 extends inward in the radial direction from the inner cylinder portion 22 fixed inside the annular recess portion 18 of the top plate 17, and the outer conversion cylinder portion 55 in which the guide protrusion portions 43 are formed extends upward from the inner circumferential edge of this receiving portion 54. According to this configuration, since rigidity of the receiving portion 54 and the outer conversion cylinder portion 55 is enhanced, and deformation or displacement of the outer conversion cylinder portion 55 due to the elastic force of the biasing member 21 is prevented, the positional relationship between the guide protrusion portions 43 and the slide protrusion portions 42 can be stabilized. Accordingly, excellent operational effects of the guide protrusion portions 43 and the slide protrusion portions 42 as described above can be reliably achieved, and the biasing member 21 and the outer conversion cylinder portion 55 can be installed inside the mouth portion 12*a* of the container main body 12 in a compact manner.

In addition, since the angle formed by the first perpendicular surface 43*a* and the first inclined surface 43*b* of the guide protrusion portion 43 and the angle formed by the second perpendicular surface 42*a* and the second inclined surface 42*b* of the slide protrusion portion 42 are equivalent to each other, when the slide protrusion portion 42 slides on the guide protrusion portion 43 in the circumferential direction, the contact area between the first inclined surface 43*b* and the second inclined surface 42*b* can be increased. Accordingly, for example, abrasion of the slide protrusion portion 42 and the guide protrusion portion 43 can be prevented when the slide protrusion portion 42 slides on the guide protrusion portion 43, and the operation can be stabilized.

In addition, the angles of the first inclined surface 43*b* and the second inclined surface 42*b* are equivalent to each other, and a plurality of guide protrusion portions 43 and a plurality of slide protrusion portions 42 are provided at intervals in the circumferential direction. Therefore, during an operation of rotating the outer casing unit 15, inclination of the central axis of the inner plate 16 with respect to the container axis O can be prevented, so that the inner plate 16 can be smoothly rotated with respect to the container body 11 without being caught.

Moreover, both the guide protrusion portion 43 and the slide protrusion portion 42 have the perpendicular surfaces 43*a* and 42*a* extending in the vertical direction. Therefore, rotation of the outer casing unit 15 and the inner plate 16 around the container axis O with respect to the container body 11 can be allowed in only one direction, and the slide protrusion portion 42 which has arrived at the escape portion 55*e* can be promptly moved upward due to the upward biasing force of the biasing member 21. Accordingly, operability at the time of rotating the outer casing unit 15 with respect to the container body 11 can be improved, the rate and the amount of a content discharged to the molding surface 27 are stabilized, and the accuracy of molding a molded article can be more reliably improved.

In addition, since the guide protrusion portion 43 has the curved surface 43*c* protruding downward and the slide protrusion portion 42 has the curved surface 42*c* protruding upward, the slide protrusion portion 42 can smoothly pass over the guide protrusion portion 43 in the circumferential direction.

In the second modification example, the slide protrusion portions 42 are provided in the inner plate 16, and the guide protrusion portions 43 are provided in the fixing member 13. However, the present invention is not limited thereto. For example, the slide protrusion portions 42 may be provided in the fixing member 13, and the guide protrusion portions 43 may be provided in the inner plate 16.

In addition, in the second modification example, the guide protrusion portions 43 are provided in the fixing member 13 fixed to the container main body 12, that is, the guide protrusion portions 43 are indirectly provided to the container main body 12. However, the present invention is not limited thereto. For example, the guide protrusion portions 43 may be integrally formed with the mouth portion 12*a* of the container main body 12 and may be directly provided to the container main body 12.

In addition, the slide protrusion portions 42 and the guide protrusion portions 43 are not limited to the second modification example, and various forms can be employed. For example, in the second modification example, four slide protrusion portions 42 and four guide protrusion portions 43 are provided. However, the present invention is not limited thereto. For example, one slide protrusion portion 42 and one guide protrusion portion 43 may be provided. In this case, one escape portion 55*e* may have a C-shape in plan view, and the guide protrusion portion 43 may be sandwiched between both circumferential end portions of the escape portion 55*e* in the circumferential direction.

In addition, the angle formed by the first inclined surface 43*b* and the first perpendicular surface 43*a* and the angle formed by the second inclined surface 42*b* and the second perpendicular surface 42*a* do not have to be equivalent to each other. In addition, the slide protrusion portions 42 may be formed to have a pillar shape protruding outward in the radial direction from the inner conversion cylinder portion 132.

In addition, in the second modification example, a ratchet mechanism in which rotation of the outer casing unit 15 and the inner plate 16 around the container axis O with respect to the container body 11 is allowed in only one direction is employed. However, the present invention is not limited thereto. For example, the outer casing unit 15 and the inner plate 16 may be provided to be integrally rotatable in both directions around the container axis O with respect to the container body 11.

Moreover, in order to more accurately form a molded article, in place of a discharge valve of the discharger 14, for example, a constant flow valve for discharging a constant amount of a content with an operation of pushing the stem 19 once may be employed.

Furthermore, within a range not departing from the gist of the present invention, the constituent elements in the foregoing embodiments can be suitably replaced with known constituent elements, and the foregoing modification examples may be suitably combined.

Next, a verification test for the operational effects described above will be described.

In this verification test, molding heads of Example 1 and Example 2 were prepared.

Example 1 employed a configuration in which, in the molding head 10 of the first embodiment, a plurality of shaping holes 26 were formed in the outer circumferential edge portion of the top wall portion 24 of the outer casing unit 15 at intervals in the circumferential direction, the first inner protrusion portion 40*a* and the second inner protrusion portion 41 were formed on the inner surface of the shaping hole 26, and no shaping hole was formed in a part positioned on the inner side, in the radial direction, of the outer circumferential edge portion of the top wall portion 24.

Figure 16:
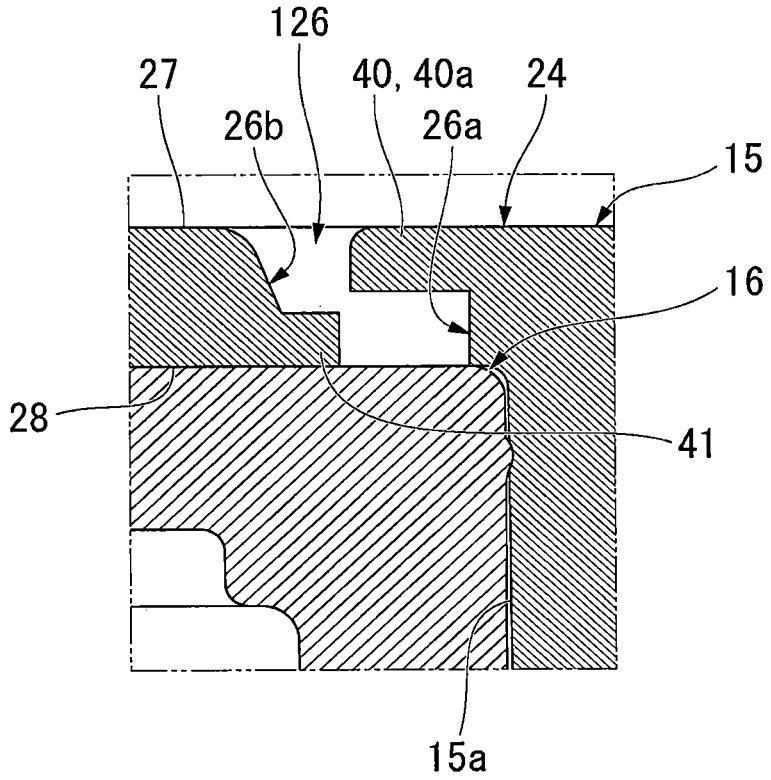
FIG. 16 is an enlarged view of a main part of a molding head of Example 2 in a verification test according to the present invention.

Example 2 employed a molding head in which a plurality of shaping holes 126 as illustrated in FIG. 16 were formed in the outer circumferential edge portion of the top wall portion 24 of the outer casing unit 15 at intervals in the circumferential direction, the shaping hole 126 extends in the vertical direction and has a mirror image relationship of the shaping hole 26 of Example 1 illustrated in FIG. 2, with a straight line passing through a middle portion of the shaping hole 26 in a width direction, and no shaping hole was formed in a part positioned on the inner side in the radial direction of the outer circumferential edge portion of the top wall portion 24. In Example 2, the facing surface 26*a* was positioned on the outer side in the radial direction and was directed inward in the radial direction, and the guide surface 26*b* was positioned on the inner side in the radial direction and was directed outward in the radial direction.

The sizes of the shaping holes 26 of Example 1 and the sizes of the shaping holes 126 of Example 2 were the same as each other. In both Examples 1 and 2, the upper end opening portion 19*a* of the stem 19 was directed to a middle portion of the supply surface 28 of the top wall portion 24 in the radial direction.

A content M which passed through each of the shaping holes 26 and the shaping holes 126 of the molding heads of Example 1 and Example 2 and arrived at the molding surface 27 was photographed.

FIGS. 17A, 17B, 18A, and 18B illustrate the results thereof.

Figure 17A:
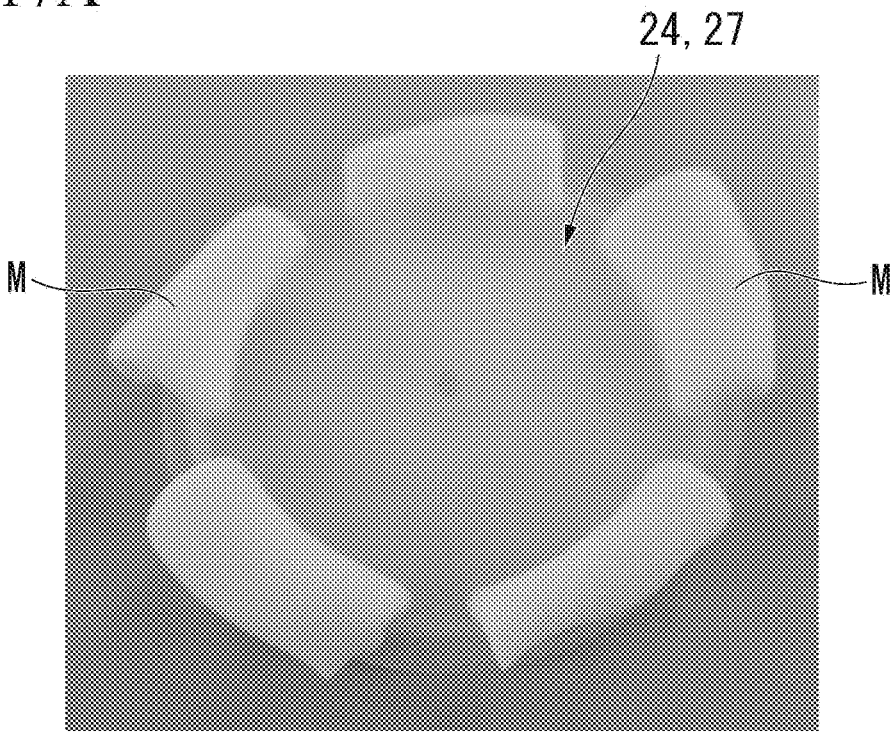
FIG. 17A is a photograph showing a test result obtained using a molding head of Example 1 in the verification test according to the present invention.
Figure 17B:
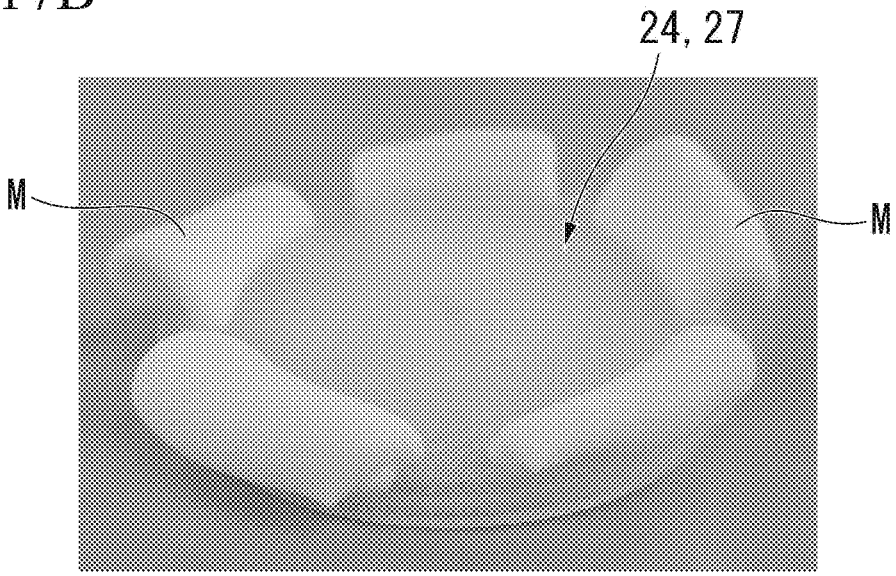
FIG. 17B is another photograph showing the test result obtained using the molding head of Example 1 in the verification test according to the present invention.
Figure 18A:
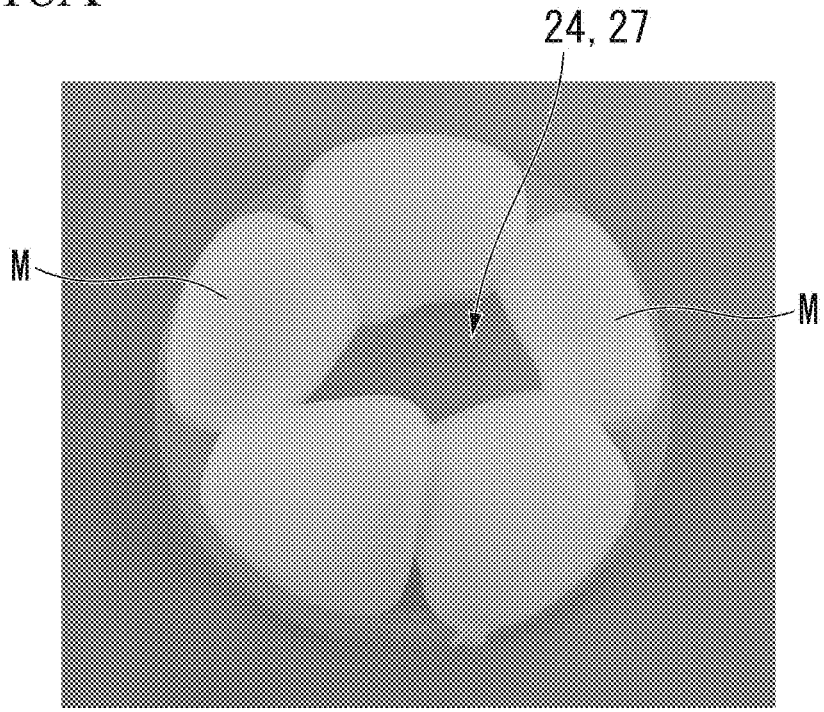
FIG. 18A is a photograph showing a test result obtained using a molding head of Example 2 in the verification test according to the present invention.
Figure 18B:
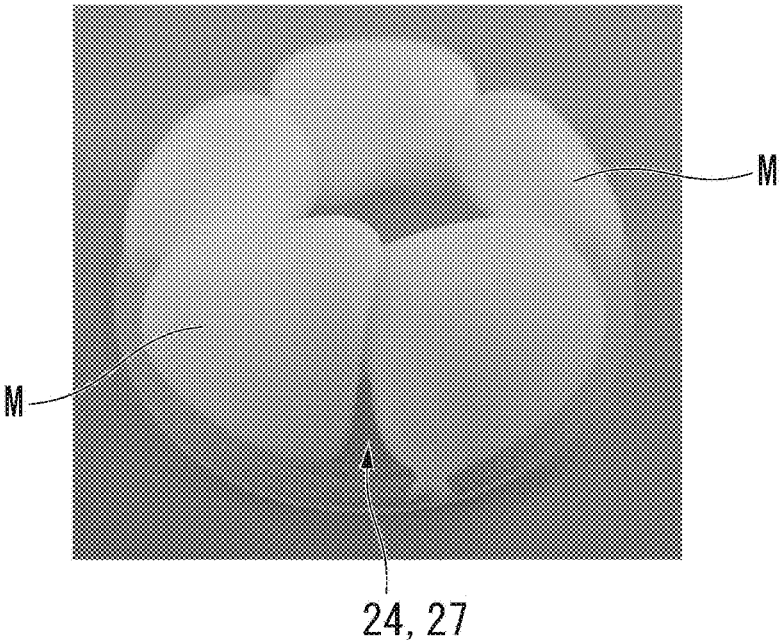
FIG. 18B is another photograph showing the test result obtained using the molding head of Example 2 in the verification test according to the present invention.

In Example 1, as illustrated in FIGS. 17A and 17B, it was confirmed that the content M could be positioned on the molding surface 27 in a state of being inclined outward in the radial direction. In Example 2, as illustrated in FIGS. 18A and 18B, it was confirmed that the content M could be positioned on the molding surface 27 in a state of being inclined inward in the radial direction. That is, it was confirmed that the inclination directions of molding pieces with respect to the molding surface 27 could be set by changing the shape of the guide protrusion portion 40.

INDUSTRIAL APPLICABILITY

According to this invention, forms of molding pieces can be adjusted while the accuracy is maintained, regardless of a distance from a discharge hole, a shape, a size, and the like of a shaping hole.

REFERENCE SIGNS LIST

10 Molding head
15 Outer casing unit
16 Inner plate
19*a* Discharge hole (upper end opening portion of stem)
24 Top wall portion
26, 126 Shaping hole
26*a* Facing surface (opposite inner surface, side surface)
26*b* Guide surface (side surface)
27 Molding surface
28 Supply surface
35 Dispersion chamber
40 Guide protrusion portion
40*b* Outer protrusion portion
40*a* First inner protrusion portion
41 Second inner protrusion portion

The invention claimed is:

1. A molding head, comprising:

an outer casing unit that has a top wall portion which is installed above a discharge hole for discharging a content which is a foam or a high-viscosity material, and in which a plurality of shaping holes penetrated in a vertical direction are disposed, and that causes a molding surface of the top wall portion to discharge the content which has passed through the shaping holes, the molding surface being directed upward;

an inner plate that is disposed inside the outer casing unit and defines, between the inner plate and a supply surface of the top wall portion, a dispersion chamber which disperses the content from the discharge hole in a radial direction along the molding surface and supplies the content to the shaping holes, the supply surface being directed downward; and a guide protrusion portion with which the content collides to be introduced to openings of the shaping holes on a molding surface side is formed on at least one of inner surfaces of the plurality of shaping holes, or in at least one of circumferential opening edge portions of the plurality of shaping holes on a supply surface side, wherein the molding head is configured to form a molded article on the molding surface by combining a plurality of molding pieces formed by the content from the dispersion chamber passing through the plurality of shaping holes.

2. The molding head according to claim 1, wherein at least one of the plurality of shaping holes has a guide surface, at least an end portion of the guide surface on the molding surface side extending gradually away from an opposite inner surface facing the guide surface while going from the supply surface side to the molding surface side in a longitudinal sectional view in the vertical direction.

3. The molding head according to claim 2, wherein at least the end portion of the guide surface on the molding surface side has a protruding curved line shape in the longitudinal sectional view.

4. The molding head according to claim 2, wherein the guide protrusion portion includes an outer protrusion portion which protrudes downward from a part, of the circumferential opening edge portion of the shaping hole on the supply surface side, connected to the guide surface of the shaping hole in the longitudinal sectional view.

5. The molding head according to claim 3, wherein the guide protrusion portion includes an outer protrusion portion which protrudes downward from a part, of the circumferential opening edge portion of the shaping hole on the supply surface side, connected to the guide surface of the shaping hole in the longitudinal sectional view.

6. The molding head according to claim 2, wherein the guide protrusion portion includes a first inner protrusion portion which protrudes from the opposite inner surface toward the guide surface in the shaping hole in the longitudinal sectional view.

7. The molding head according to claim 6, wherein a second inner protrusion portion which protrudes toward the opposite inner surface is formed on a part, of the guide surface of the shaping hole, positioned below the first inner protrusion portion formed on the opposite inner surface in the longitudinal sectional view.

8. The molding head according to claim 1, wherein in at least one of the plurality of shaping holes, an opening area on the molding surface side is smaller than an opening area on the supply surface side.

9. The molding head according to claim 6, wherein in at least one of the plurality of shaping holes, an opening area on the molding surface side is smaller than an opening area on the supply surface side.

10. The molding head according to claim 7, wherein in at least one of the plurality of shaping holes, an opening area on the molding surface side is smaller than an opening area on the supply surface side.

11. The molding head according to claim 1, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

12. The molding head according to claim 6, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

13. The molding head according to claim 7, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

14. The molding head according to claim 8, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

15. The molding head according to claim 9, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

16. The molding head according to claim 10, wherein at least one of the plurality of shaping holes is a long hole, and wherein the guide protrusion portion is formed on a side surface, of the inner surface defining the long hole, extending in a direction in which the long hole extends, or in a part, of the circumferential opening edge portion of the long hole on the supply surface side, connected to the side surface.

* * * * *